US009809789B2

(12) United States Patent
Lin et al.

(10) Patent No.: US 9,809,789 B2
(45) Date of Patent: Nov. 7, 2017

(54) HEATED CLEANING ARTICLES USING A CALCIUM OXIDE AND WATER HEAT GENERATOR

(71) Applicant: THE CLOROX COMPANY, Oakland, CA (US)

(72) Inventors: Brian Lin, Pleasanton, CA (US); Kerry Azelton, Pleasanton, CA (US); Vismadeb Mazumder, San Jose, CA (US); Maria G. Ochomogo, Pleasanton, CA (US); William R. Ouellette, Livermore, CA (US); Bryan K. Parrish, Pleasanton, CA (US); Michael J. Petrin, Walnut Creek, CA (US); Richard J. Uriarte, Danville, CA (US)

(73) Assignee: The Clorox Company, Oakland, CA (US)

( * ) Notice: Subject to any disclaimer, the term of this patent is extended or adjusted under 35 U.S.C. 154(b) by 25 days.

(21) Appl. No.: 15/057,524

(22) Filed: Mar. 1, 2016

(65) Prior Publication Data

US 2016/0272925 A1 Sep. 22, 2016

Related U.S. Application Data

(60) Provisional application No. 62/134,264, filed on Mar. 17, 2015, provisional application No. 62/140,384, filed on Mar. 30, 2015.

(51) Int. Cl.
*A47L 13/16* (2006.01)
*C11D 17/04* (2006.01)
(Continued)

(52) U.S. Cl.
CPC ..... *C11D 17/049* (2013.01); *B08B 1/006* (2013.01); *B08B 3/04* (2013.01); *B08B 3/10* (2013.01); *A47L 13/225* (2013.01); *C11D 17/041* (2013.01)

(58) Field of Classification Search
CPC ..... A47L 13/225
(Continued)

(56) References Cited

U.S. PATENT DOCUMENTS 3,152,181 A 10/1964 Freedman
3,338,992 A 8/1967 Kinney
(Continued)

OTHER PUBLICATIONS

International Search Report, dated May 17, 2016, from counterpart PCT/US16/20718, filing date Mar. 3, 2016.
(Continued)

*Primary Examiner* — David Walczak
*Assistant Examiner* — Joshua Wiljanen
(74) *Attorney, Agent, or Firm* — Alok Goel

(57) ABSTRACT

Cleaning articles including a heat engine incorporated therein. The cleaning article may include a substrate (e.g., a non-woven wipe) including one or more layers. The heat engine may be in the wipe or pad, and includes a reactive metal oxide which upon contact with water, reacts to produce heat. The cleaning article may thus produce water vapor and/or steam upon activation of the heat engine. A venting structure may be provided adjacent to or surrounding the heat engine that includes an impermeable material (e.g., impermeable to water and/or air or other gas), which includes one or more vents through the impermeable material. The venting structure directs water vapor and/or steam to a desired face of the cleaning article, away from the user. A heat barrier layer may insulate a user's hand from the generated heat, and/or a handle may be attachable to the pad.

19 Claims, 9 Drawing Sheets

(51) Int. Cl.

| | |
|---|---|
| ***B08B 1/00*** | (2006.01) |
| ***B08B 3/04*** | (2006.01) |
| ***B08B 3/10*** | (2006.01) |
| *A47L 13/22* | (2006.01) |

(58) Field of Classification Search
USPC ..... 401/1, 2
See application file for complete search history.

(56) References Cited

U.S. PATENT DOCUMENTS

| | | | | |
|---|---|---|---|---|
| 3,341,394 | A | 9/1967 | Kinney | |
| 3,502,538 | A | 3/1970 | Petersen | |
| 3,502,763 | A | 3/1970 | Hartmann | |
| 3,542,615 | A | 11/1970 | Dobo et al. | |
| 3,692,618 | A | 9/1972 | Dorchner et al. | |
| 3,695,066 | A | 10/1972 | Doyel | |
| 3,802,817 | A | 4/1974 | Matsuki et al. | |
| 3,835,057 | A | 9/1974 | Cheng et al. | |
| 3,849,241 | A | 11/1974 | Butin et al. | |
| 3,929,678 | A | 12/1975 | Laughlin | |
| 4,017,414 | A | 4/1977 | Black | |
| 4,041,203 | A | 8/1977 | Brock | |
| 4,163,800 | A | 8/1979 | Wickett | |
| 4,205,957 | A | 6/1980 | Fujiwara | |
| 4,259,217 | A | 3/1981 | Murphy | |
| 4,264,362 | A | 4/1981 | Sergev et al. | |
| 4,340,563 | A | 7/1982 | Appel et al. | |
| 4,488,928 | A | 12/1984 | Ali Khan | |
| 4,714,563 | A | 12/1987 | Kajas | |
| 4,818,464 | A | 4/1989 | Lau | |
| 5,169,706 | A | 12/1992 | Collier, IV | |
| 5,607,980 | A | 3/1997 | McAtee et al. | |
| 5,611,329 | A | 3/1997 | Lamensdorf | |
| 5,681,802 | A | 10/1997 | Fujiwara et al. | |
| 5,686,089 | A | 11/1997 | Mitra | |
| 5,918,590 | A | 7/1999 | Burkett et al. | |
| 5,942,481 | A | 8/1999 | Talley | |
| 5,984,995 | A | 11/1999 | White | |
| 6,613,704 | B1 | 9/2003 | Arnold | |
| 6,824,557 | B2 * | 11/2004 | Tone | A61F 7/034 607/112 |
| 7,568,255 | B1 * | 8/2009 | Krebs | C09K 5/063 15/104.93 |
| 2001/0032403 | A1 | 10/2001 | Har et al. | |
| 2002/0106478 | A1 | 8/2002 | Hayase et al. | |
| 2003/0106568 | A1 | 6/2003 | Keck | |
| 2003/0136031 | A1 | 7/2003 | Cordes | |
| 2007/0254825 | A1 | 11/2007 | Shannon et al. | |
| 2008/0254081 | A1 | 10/2008 | Schroeder et al. | |
| 2010/0163011 | A1 | 7/2010 | Tinker et al. | |
| 2010/0326418 | A1 | 12/2010 | Sesock et al. | |
| 2012/0145189 | A1 | 6/2012 | Knopow et al. | |
| 2013/0119301 | A1 | 5/2013 | Sunol et al. | |
| 2013/0345649 | A1 | 12/2013 | Stockley et al. | |
| 2015/0232254 | A1 | 8/2015 | Huffer et al. | |

OTHER PUBLICATIONS

International Search Report, dated May 20, 2016, from counterpart PCT/US2016/020726, filing date Mar. 3, 2016.
International Search Report, dated May 17, 2016, from counterpart PCT/US2016/020728, filing date Mar. 3, 2016.
U.S. Office Action dated Jun. 9, 2017, U.S. Appl. No. 15/057,464, filed Mar. 1, 2016.

* cited by examiner

HEATED CLEANING ARTICLES USING A CALCIUM OXIDE AND WATER HEAT GENERATOR

CROSS-REFERENCE TO RELATED APPLICATIONS

This application claims priority to and the benefit of U.S. Provisional Patent Application No. 62/134,264 filed Mar. 17, 2015, entitled HEATED CLEANING ARTICLES USING A REACTIVE METAL AND SALINE HEAT GENERATOR, which is incorporated by reference in its entirety. This application also claims priority to and the benefit of U.S. Provisional Patent Application No. 62/140,384 filed Mar. 30, 2015, entitled HEATED CLEANING ARTICLES USING AN OXYGEN ACTIVATED HEAT GENERATOR, which is incorporated by reference in its entirety.

BACKGROUND OF THE INVENTION

1. The Field of the Invention

The present invention relates to self-heated cleaning articles, e.g., a wipe or other cleaning substrate that includes a heat engine capable of producing heat that can be used in delivering a cleaning composition (which may simply be heated water) in a heated condition, to improve cleaning efficacy.

2. Description of Related Art

Cleaning devices and articles (e.g., wipes) are used extensively in cleaning various environments both at home, and in various other settings (e.g., hospitals, retail centers, restaurants, businesses, assisted living centers, etc.). While heated water (and/or other heated cleaning compositions) may be recognized to provide improved cleaning efficacy, there is little in the way of consumer products currently available that conveniently provide heat at the time and place where cleaning is to occur, e.g., that would heat the cleaning composition at the time of use, in a substantially automated fashion.

BRIEF SUMMARY OF THE INVENTION

Although there exist various products that employ heat generators that use exothermic reactions to generate heat (e.g., in heating MRE meals, hand and boot warmers, and the like), heat generators have not been adapted for use in cleaning articles. Heat and/or steam dramatically improves the efficacy of many cleaning compositions and/or the cleaning substrate itself, and there is a need for convenient, safe, self-heating cleaning articles that consumers may easily use for various cleaning applications. According to one embodiment, the present invention relates to use of a reactive metal oxide (e.g., an oxide of an alkali or alkaline earth metal such as calcium oxide) and water to generate heat within the cleaning article (e.g., a wipe) itself. The water composition may be provided pre-packaged, e.g., in a pouch within the pad or wipe, or may be added by the user (e.g., by placing the pad or wipe under a faucet, introducing water through a handle, etc.).

Use of such a reactive metal oxide and water heat generator with a cleaning article presents a number of difficulties to be addressed in order to create a product safe for consumer use. For example, some such difficulties may include the ability to provide control over the amount of water added to the reactive metal oxide, control of temperatures achieved by the heat engine, control over directional flow of steam, water vapor and/or other vapors generated during use, and otherwise ensuring that the heated cleaning article is safe for consumer use. Embodiments of the invention as described herein may address one or more of the above issues.

The terms steam and water vapor as employed herein are to be construed broadly. For example, it is not required that the steam or water vapor generated by the heat engine actually be in gaseous phase (which would not be visible). Rather, at least some of the generated steam and/or water vapor can be what may sometimes be referred to as "wet steam", including a visible mist or aerosol of airborne water droplets, which stream is observed to be visibly emitted from the cleaning article during use.

One aspect of the invention is directed to a cleaning article comprising a substrate material comprising one or more layers. The cleaning article may further include a heat engine including a reactive metal oxide composition. In an embodiment, water may be provided externally, e.g., through a handle, immersion in flow of a faucet, or in a frangible, moisture impermeable pouch. Where a pouch of the activating water is provided in the wipe or other cleaning article, the water composition and reactive metal oxide composition may be initially separated from one another, to prevent premature reaction between the two. Upon contact of reactive metal oxide with the activating water, heat is generated.

The cleaning article may further include a venting structure adjacent to or surrounding the heat engine, which venting structure may include a material that is impermeable to moisture (e.g., and optionally air). One or more vents (e.g., holes) may be formed through the impermeable material, to allow steam and/or water vapor generated by the heat engine to be directed through the vent(s) to at least one surface of the cleaning article. For example, the venting structure may direct the steam and/or water vapor to the face of the cleaning article that the user presses against the surface being cleaned (e.g., tile, countertop, sink, bathtub, etc).

Exemplary layers may include nonwoven natural fibers (cotton, pulp, etc.), nonwoven synthetic materials (polyethylene, polypropylene, polyester, etc.), a nonwoven comprising both natural and synthetic fibers, foils (aluminum film, a heat shield, etc.), membranes (water/moisture impermeable, air-impermeable, air permeable, etc.), foams, woven materials, sponges, or combinations thereof.

As mentioned, an embodiment of the heated cleaning article of the invention may include a substrate material including one or more layers, a heat engine, and a venting structure surrounding the heat engine. The heat engine includes a reactive metal oxide composition, water may be provided in a frangible, moisture impermeable pouch. Other components (e.g., cleaning composition components) may optionally be packaged with the water composition, if desired. In another embodiment, a cleaning composition could be separately packaged from the water (e.g., in its own pouch, or placed on or within one or more of the substrate layers of the wipe or pad. The venting structure may include an impermeable material serving as a barrier to moisture and/or air, and which includes one or more vents (e.g., holes) through the impermeable material.

As will be appreciated, in an embodiment, the activating water may be provided inside the wipe or other cleaning article (e.g., configured as a "pad"). In another embodiment, the activating water may be added to the pad via an external source (e.g., by placing the wipe, pad, or other cleaning article under a faucet). In another embodiment, activating water may be added to the wipe, pad, or other cleaning article through a handle attachable thereto. Such a handle may include a dispenser, trigger, button, or other mechanism for dosing or otherwise controlling the rate at which water is added from the handle into the cleaning article, activating the heat engine.

In any embodiment, the heat generator may heat the substrate material and the user may use the heated substrate for a wide variety of cleaning applications. In addition to heating the substrate, heated water vapor and/or steam may typically be emitted from the substrate, aiding in cleaning. The temperature provided by the heat engine, and the length of time that such heat is provided, may depend on the amount of reactive metal oxide and water provided with the heat generator.

Further features and advantages of the present invention will become apparent to those of ordinary skill in the art in view of the detailed description of preferred embodiments below.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

I. Definitions

Figure 1:
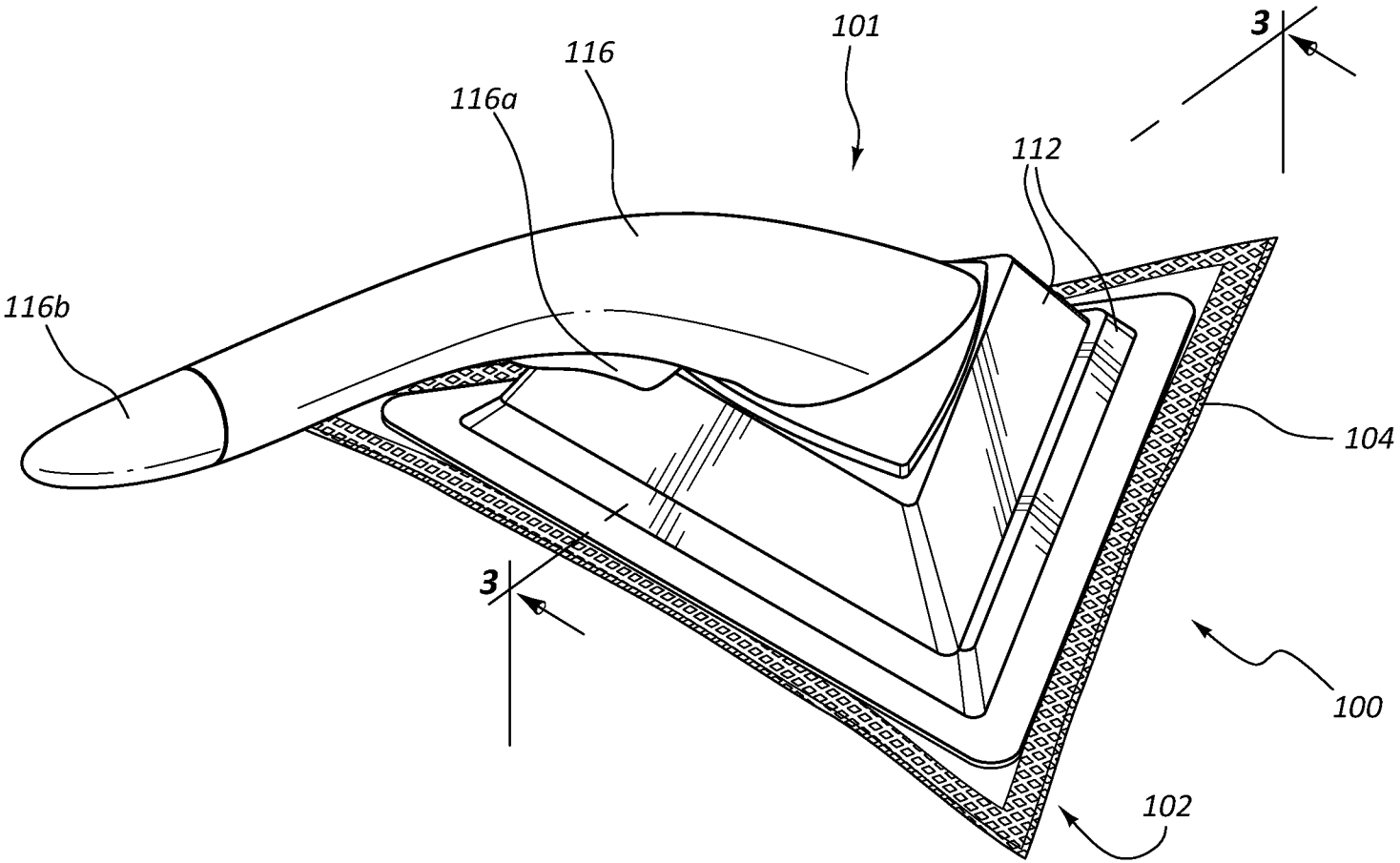
FIG. 1 is a perspective view of an exemplary cleaning article according to an embodiment of the present invention, including a handle attachable thereto.

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

References herein to "one embodiment", "one aspect" or "one version" of the invention include one or more such embodiment, aspect or version, unless the context clearly dictates otherwise.

The term "comprising," which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claim.

It must be noted that, as used in this specification and the appended claims, the singular forms "a," "an" and "the" include plural referents unless the content clearly dictates otherwise. Thus, for example, reference to a "layer" includes one, two or more such layers.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

Some ranges may be disclosed herein. Additional ranges may be defined between any values disclosed herein as being exemplary of a particular parameter. All such ranges are contemplated and within the scope of the present disclosure.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values include at least the variation to be expected in a typical manufacturing or formulation process, and may include values that are within 10%, within 5%, within 1%, etc. of a stated value. Furthermore, the terms "substantially", "similarly", "about" or "approximately" as used herein represent an amount or state close to the stated amount or state that still performs a desired function or achieves a desired result. For example, the term "substantially" "about" or "approximately" may refer to an amount that is within 10% of, within 5% of, or within 1% of, a stated amount or value.

Unless otherwise stated, all percentages, ratios, parts, and amounts used and described herein are by weight.

As used herein, the terms "cleaning article", "pad", and "wipe" are intended to include any material which may be used for a cleaning application. In functional application, cleaning article is used to clean a surface, e.g., such as by wiping, rubbing or scrubbing. The cleaning article includes a substrate. Substrates comprise woven or non-woven materials, typically made from a plurality of fibers, as well as sponges, films and similar materials into which the heat engine can be packaged, as described herein. The cleaning article can be used by itself (typically by hand) or attached to a cleaning implement, such as a handle, a floor mop, or a hand-held cleaning tool, such as a toilet cleaning device, or similar.

"Cleaning composition" or "treatment composition" as used herein, is any fluid and/or solid composition used for cleaning or treating hard surfaces, soft surfaces, air, etc. Cleaning means any treatment of a surface which serves to remove or reduce unwanted or harmful materials such as soil, dirt, spills, debris, spores, mold or microbial contamination from a surface, and/or which imparts a desirable or beneficial aesthetic, health or safety effect to the surface such as depositing thereon a fragrance, color or protective coating or film.

As used herein, the term "x-y dimension" refers to the plane orthogonal to the thickness of a substrate sheet. The x and y dimensions correspond to the length and width, respectively, of the sheet. In this context, the length of the sheet is the longest dimension of the sheet, and the width the shortest. Of course, the present invention is not limited to the use of cleaning substrates having a rhomboidal shape. Other shapes, such as circular, elliptical, and the like, can also be used.

As used herein, the term "z-dimension" refers to the dimension orthogonal to the length and width of the cleaning substrate, or a component thereof. The z-dimension therefore corresponds to the thickness of the cleaning substrate, article, or component thereof. As used herein, the term "z-dimension expansion" refers to imparting bulk or thickness to a fibrous web by moving fibers out of the x-y dimension and into the z-dimension. A fibrous web with z-dimension expansion can be created by a wide variety of methods, including but not limited to, air texturing, abrasion bulking, embossing, thermoforming, felting, SELFing and any other suitable methods.

As used herein, the term "fiber" refers to a thread-like object or structure from which textiles and non-woven fabrics are commonly made. The term "fiber" is meant to encompass both continuous and discontinuous filaments, and other thread-like structures having a length that is substantially greater than its diameter.

As used herein, the terms "non-woven" or "non-woven web" means a web having a structure of individual fibers or threads which are interlaid, but not in a regular and identifiable manner as in a woven or knitted web. The fiber diameters used in non-wovens are usually expressed in microns, or in the case of staple fibers, denier. Non-woven webs may be formed from many processes, such as, for example, by meltblowing, spunbonding, carded, airlaid, wetlaid, thermal bonded, needled/felted, hydroentangled, and/or combinations thereof.

II. Introduction

The present invention relates to the incorporation of heat engines into a cleaning article. The cleaning article may include a substrate (e.g., a non-woven wipe) including one or more layers. A heat engine may be incorporated into the cleaning article (e.g., into the layers of the wipe or pad). The heat engine may include a reactive metal oxide which upon contact with water, reacts to produce heat. The cleaning article may thus produce water vapor and/or steam upon activation of the heat engine. For example, an excess of water may be provided so that water not consumed in the reaction (e.g., in forming the metal hydroxide) is available to be heated, and emitted as steam and/or water vapor. A venting structure may be provided adjacent to or surrounding the heat engine that includes an impermeable material (e.g., impermeable to water and/or air), which includes one or more vents through at least one surface of the impermeable material. For example, the venting structure may direct water vapor and/or steam to a desired face of the cleaning article, while preventing or at least minimizing flow of water vapor and/or steam to other surfaces of the pad or other cleaning article. Such venting structure thus aids in delivering the water vapor and/or steam adjacent a cleaning or scrubbing surface of the cleaning article.

III. Exemplary Heated Cleaning Articles

In the context of the present invention, the terms "heat engine" and "heat generator" are used interchangeably with one another. A heat engine includes a composition of one or more reactive metal oxides and a source of activating water. Other constituents may be present within either the reactive metal oxide composition, the activating water composition, or both. By way of example, the reactive metal oxide composition may include calcium oxide. Other metal oxides that may be suitable for use include other alkaline earth oxides (e.g., magnesium oxide). Various alkali metal oxides (e.g., sodium oxide, and/or potassium oxide) may also be suitable for use. Various other reactive metal oxides that react with water exothermically may also be suitable for use. Combinations of any of the above may be employed.

The reactive metal oxide may be provided as a particulate (e.g., powder) within a pouch or other suitable container. The reactive metal oxide could also simply be dispersed within the fibrous web of the non-woven or other substrate material, if desired. Alternatively, the reactive metal oxide composition may be formed into a shaped article of any desirable shape (e.g. flat rectangle, rod, strip, etc.) In any case the reactive metal oxide composition should be kept substantially dry prior to reacting with the activating water. To ensure that the heat generator is not inadvertently activated during production, transportation, shipping, handling or inadvertent action by the consumer, it may be desirable to package the reactive metal oxide composition within a protective membrane. For example, such a membrane may be impermeable to water vapor, liquid water, or may be a membrane that exhibits low permeability to water vapor or liquid water. For example, it may be porous, but exhibit adsorptive characteristics, so as to stop any water from seeping therethrough to the reactive metal oxide. Such membrane may or may not be permeable to air or oxygen. Combinations of any of the above features may be provided by such a membrane or other pouch.

The heat engine may include calcium oxide provided in a desired pouch. An appropriate amount of water may be contacted with the calcium oxide in the pouch to initiate the following exothermic reaction:

$$CaO+H_2O \rightarrow Ca(OH)_2+Heat \quad (1)$$

Based upon the above reaction, the temperature may be raised by approximately 100° F. in less than 10 minutes. In some embodiments, the maximum temperature of the system may be regulated to about 212° F. by evaporation and condensation of water vapor. While effective, some safety concerns exist in providing such a system for consumer use. The heat generator pouch may produce enough heat to generate steam, which can present a burn hazard.

Calcium oxide powder may be used in the heat engines. When other factors are held constant, the rate of liberation of heat is related to the surface area of the calcium oxide reacting with the water. In addition, the size of the metal oxide particles can be selected to provide desired reaction results. For example, more finely divided calcium oxide powder reacts more rapidly and generates heat more quickly. It may generate higher temperatures. Coarser powder (larger particle sizes) react at a slower rate and generate heat more slowly, generating relatively lower temperatures. Even larger sizes (e.g., more than 1 mm average particle size) may react at an even slower rate and take longer to generate heat, although such larger "particles" may react and provide the heat over a longer time period. The rate of the reaction of the reactive metal oxide with water is thus a function of the collective surface area of the reactive metal oxide used.

In an embodiment of the invention, the particle size of the calcium oxide can be in the following ranges: about 0.5 to about 500 micrometers, about 1 to about 250 micrometers, about 1 to about 100 micrometers, about 1 to about 50 micrometers, about 1 to about 25 micrometers, about 1 to about 10 micrometers and about 5 to about 100 micrometers, and about 5 to about 50 micrometers.

In an embodiment of the invention, the weight percentage of calcium oxide as a percentage of the total metal oxide present in the reactive metal oxide composition may be 100%. The metal oxide composition may also include other constituents, e.g., so that the weight percentage of calcium oxide may be from about 85% to 100%, from about 85% to about 99.9%, from about 85% to about 99.5%, from about 85% to about 99% by weight, from about 90% to about 98% by weight, from about 92% to about 98% by weight, from 85% to 98% by weight, from about 88% to about 98% by weight, or from about 93% to about 97% by weight (e.g., 93%, 94%, 95%, 96%, 97%, 98%, 99%, or 100% by weight).

It should be appreciated by one skilled in the art that modifying the size of the reactive metal oxide particles or the amounts of reactive metal oxide and/or water may affect the reaction rate, generating heat more slowly or quickly. Depending on the application, the components of the heat engine can be adjusted to generate a warm cleaning article, a steaming cleaning article or a very hot cleaning article. In addition, if the addition of water and/or salt water is restricted (e.g. multiple pouches that are bursted sequentially, or providing a slow flow thought a restricted path, etc.) in its ability to react with the reactive metal oxide(s), then the time period over which heat is generated may be shortened or extended as desired.

In an embodiment, the heat engine heats the cleaning article to a temperature that is above ambient temperature (e.g., at least about 70° F.). More typically, the temperature achieved may be from about 70° F. to about 220° F., from about 80° F. to about 212° F., from about 80° F. to about 180° F., from about 100° F. to about 160° F., from about 110° F. to about 160° F., from about 110° F. to about 150° F., from about 110° F. to about 140° F., from about 115° F. to about 130° F., from about 115° F. to about 160° F., from about 115° F. to about 150° F., from about 115° F. to about 160° F., or from about 120° F. to about 160° F. Various ranges between any of the disclosed end point temperatures are also contemplated. The actual temperature achieved may be selected based on the contemplated use. For example, for a hand-held article, the temperature may be lower than for an article provided with a handle, where there is less risk of a user accidentally touching the heated surface.

As described herein, the heat engine comprises a reactive metal oxide, such as calcium oxide that generates heat upon contact with water. While other chemical technologies exist for creating heat, such a heat engine that relies on reaction of a reactive metal oxide with water advantageously provides sufficient heat production relative to the mass or volume of the heat engine components, does not generate hydrogen or other potentially dangerous gases during use, and does not require the inclusion of salts within the reactive water component. Such salts can leave a residue upon drying, which may be undesirable. The reactive metal oxide and water heat engine is thus economical, reliable, and generally safe for consumer use as described herein, while producing significant quantities of heat for an appropriately sized wipe or pad suitable for cleaning in a bathroom, kitchen, or similar environment. In addition, because the reaction relies on the presence of water for the reaction to proceed, this is also advantageous, as heating of the heat engine water generates steam and/or water vapor, without requiring the additional presence of another water source.

Depending on the contemplated use of the cleaning article, the temperature may be regulated to not exceed a given maximum. For example, exposure to heated water, water vapor, or other heated article can result in a burn to a user's skin if contact exceeds a certain time frame as shown in Table 1 below. Thus, in an embodiment, the temperature may be regulated to minimize the risk of burning. In addition, the cleaning article may include venting structure and/or a heat shield to further protect the user from risk of burning. In some embodiments, the cleaning article may include an attachable handle. Any of such features may allow the cleaning article to provide relatively higher temperatures, while still ensuring adequate safety for the user.

TABLE 1

| Temp. (° F.) | Approx. Time to $1^{st}$ Degree Burn | Approx. Time to $2^{nd}$ or $3^{rd}$ Degree Burn |
|---|---|---|
| 111 | 270 min | 300 min |
| 113 | 120 min | 180 min |
| 116 | 20 min | 45 min |
| 118 | 15 min | 20 min |
| 120 | 8 min | 10 min |
| 124 | 2 min | 4.2 min |
| 131 | 17 sec | 30 sec |
| 140 | 3 sec | 5 sec |
| 151 | instant | 2 sec |

Figure 2:
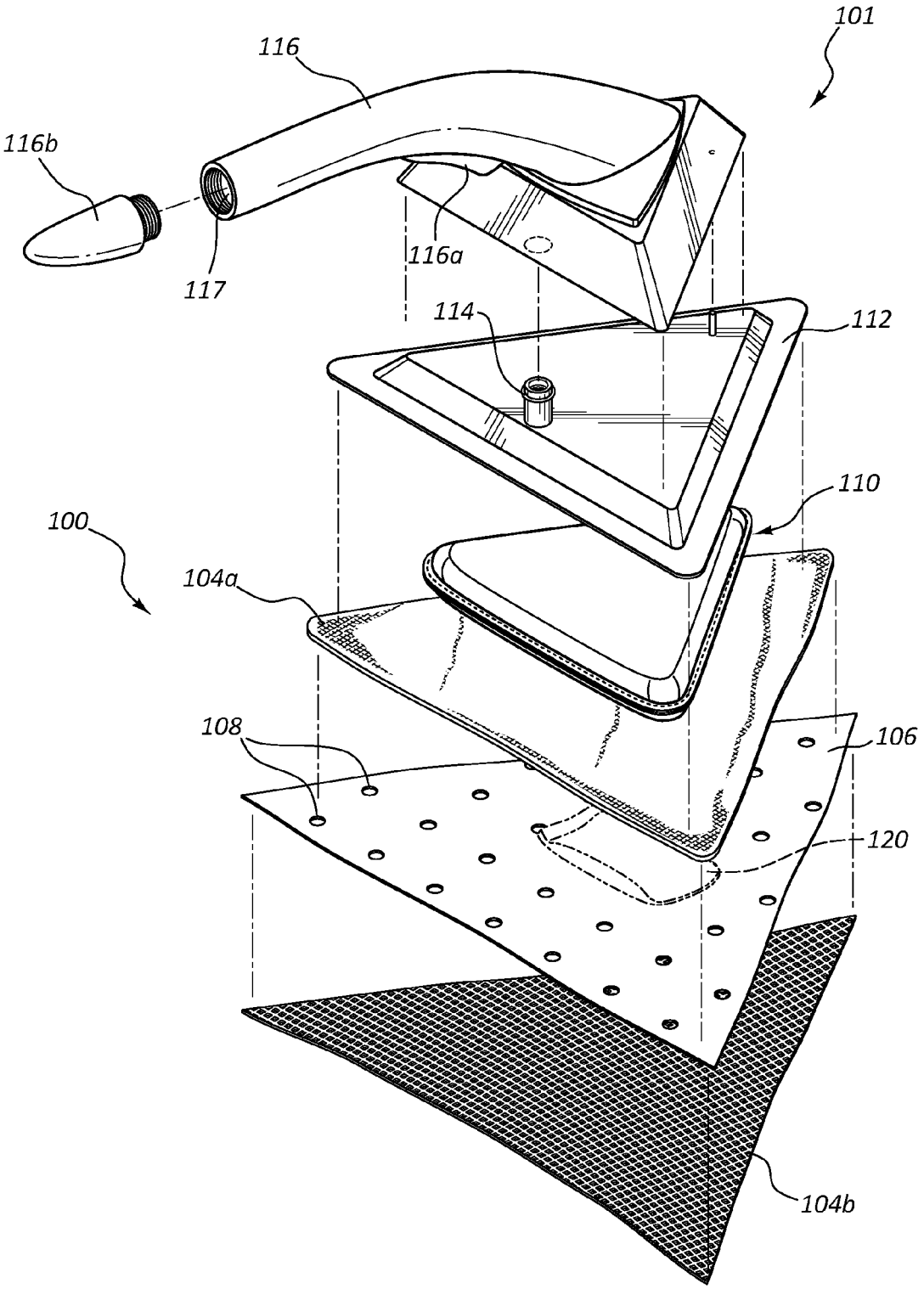
FIG. 2 is an exploded view of the cleaning article of FIG. 1.
Figure 3:
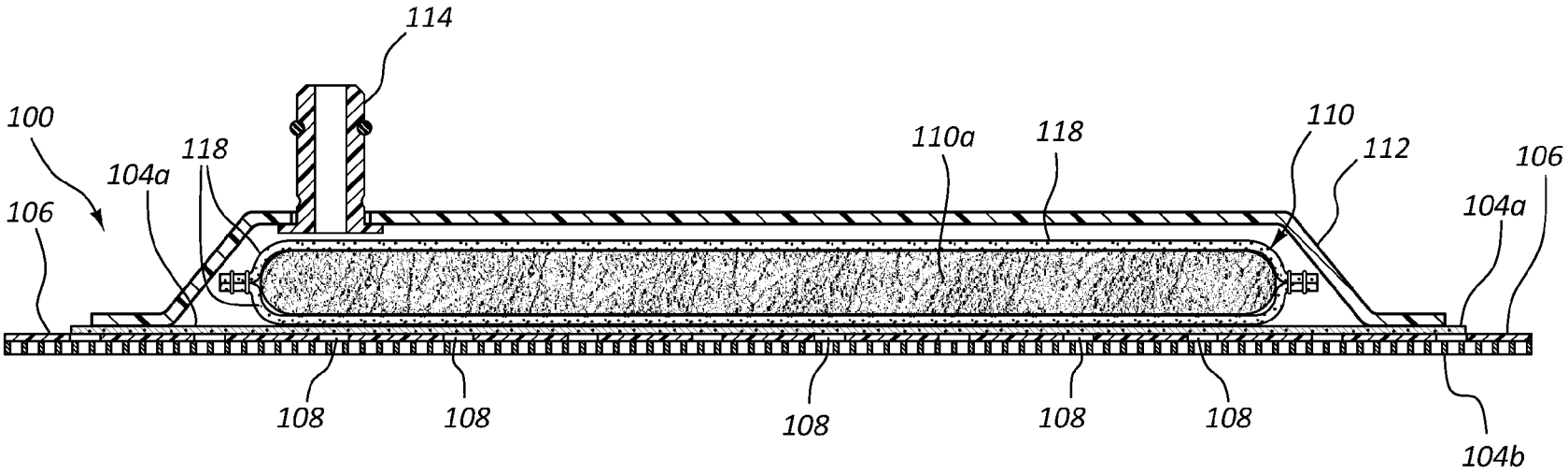
FIG. 3 a cross-sectional view through the cleaning article of FIG. 1.

FIGS. 1-3 illustrate an exemplary cleaning article 101 according to an embodiment of the present invention, configured as a pad 100 with an attachable handle 116. Pad 100 is selectively heatable, including a heat engine 110 disposed therein. Pad 100 further includes a substrate material 104, which may include one or more layers (e.g., 104*a* and 104*b*). One or more of such layers may be a non-woven, or other suitable substrate material. One of such layers (e.g., layer 104*b*), is shown disposed at a "bottom" surface 102 of the pad 100, e.g., that surface of the pad 100 that is brought to bear against tile, countertop, sink, or other surface to be cleaned.

FIG. 2 shows an exploded view, better illustrating several of the various layers and components that may be included within the cleaning pad 100. Substrate 104 is shown as including a second layer, 104*a*, with a liquid impermeable layer at 106 (e.g., polypropylene, polyethylene or the like), e.g., disposed between the substrate layers 104*a* and 104*b*. As shown in FIG. 2, layer 106 is shown as including a plurality of vent holes 108 punched or otherwise formed therethrough, such that steam and/or water vapor generated from heat engine 110 is forced to be emitted in a direction of the "bottom" surface of the cleaning pad, so that the steam and/or water vapor provided by heat engine 110 exits through vents 108, and passes through substrate layer 104*b* (e.g., a non-woven material, e.g., "scrim", as commonly referred to by those of skill in the art). Holes or vents 108 may be provided randomly across all or a portion of layer 106, or may be provided in a pattern across layer 106, as shown. It will be appreciated that the vents 108 could be positioned so in any manner desired, e.g., so as to provide steam and/or water vapor around only a periphery of the pad, only within a center portion thereof, only on one side thereof, etc., depending on a desired distribution footprint for the steam and/or water vapor.

The steam and/or water vapor generated by heat engine 110 may also pass through substrate layer 104*a*, prior to contact with impermeable (e.g., plastic barrier layer) material 106. Such layer 104*a* may be a non-woven material, similar to layer 104*b*. Such layer 104*a* may be the same or different than layer 104*b*, e.g., it may be a loft layer, or "hammock" as sometimes referred to by those of skill in the art. Layer 104*a* may advantageously be absorbent, absorbing any macro volumes of liquid water, or other liquids that may otherwise drip or seep from pad 100. Thus, the airborne steam and/or water vapor emitted from heat engine 110 is able to pass through layer 104*a*, and vents 108, for emission through final substrate layer 104*b*, while any residual liquid, non-airborne water or other liquid may be largely absorbed within layers 104*a* and/or 104*b*, preventing or minimizing any tendency of the heated liquids from dripping or seeping from the heated cleaning pad 100. Rigid housing 112 may also serve to isolate compression forces applied by pressing on the handle or otherwise on the pad 100, which isolation can aid in preventing or minimizing seepage of liquid water from the heat engine due 110 to pressure applied on the handle, to better scrub with pad 100.

Illustrated article 101 is also shown as including a scaffold or housing 112, disposed over the top face of heat engine 110. Such housing 112 may be rigid, and may include connection structure 114 for connection of the cleaning pad 100 to handle 116. Any suitable connection structure may be employed between such housing 112 of the cleaning article 100 and the handle 116. For example, various press-fit, friction-fit, screw-in, clam-shell, or other suitable mechanical couplings will be apparent to those of skill in the art. Such a connection structure 114 may be releasable, so as to allow selective connection of the handle 116 to a cleaning pad 100, use of the cleaning pad, and release of the cleaning pad after such use. The mechanism may allow release of cleaning pad 100 from handle 116 without requiring the user to touch or grip the heated cleaning pad 100. For example, a release button or other mechanism could be provided on handle 116 for selective release of the heated cleaning pad 100 after use.

The handle 116 may be configured to be used multiple times, while individual cleaning pads 100 may be intended for a single use upon activation, after which the spent cleaning pad 100 may be released from the handle 116 and disposed of. For example, a handle 116 may be provided in a package with a plurality of such cleaning pads (e.g., 3 to 10 of such pads, or any desired number). Packages of replacement cleaning pads may also be provided (e.g., 3 to 10 pads, or any desired number), without any such handle 116, to be purchased by a user who is in need of additional cleaning pads, and who already has the handle 116.

Where a rigid scaffold or housing 112 is provided on or within the cleaning article 101, a user may thus more easily apply pressure to the pad 100 of cleaning article 101, (e.g., pushing it against the surface being cleaned, using a handle, or simple hand-pressure), while minimizing a risk that liquid within the cleaning pad 100 would be squished out therefrom. The cross-section of FIG. 3 illustrates how such a rigid housing 112 may largely insulate most of layers 104*a* and 104*b* from compression, that might otherwise press such liquids absorbed within such layers, and/or heat engine 110.

As described herein, various mechanisms for providing the activating water to the reactive metal oxide of the heat engine 110 are contemplated. Such activating water may be present within the cleaning pad 100 with the reactive metal oxide (e.g., but packaged in a separate frangible pouch). In another embodiment, the activating water could be added to pad 100 via an external source, such as a faucet. In another embodiment, where a handle is provided as in FIG. 1, the activating water may be added to the pad 100 through handle 116. In any embodiment, a one-way valve may be provided to allow entrance of water therethrough to the heat engine, but which does not allow water vapor and/or steam generated by the heat engine to escape therethrough, or order to better direct flow of steam and/or heated water vapor generated from the heat engine away from the user.

As such, the heat engine 110 may include just the reactive metal oxide composition, or may include both the reactive metal oxide composition, and a pouch of activating water. Where an elongate handle such as that of FIG. 1 is provided, it may be desirable to allow the user to add the water through the handle or the reservoir, rather than providing it prepackaged within the cleaning pad 100.

The cross-section of FIG. 3 shows how activating water may be introduced into pad 100 through the handle 116, e.g., through connector 114. FIG. 1 shows how the distal end 116*b* of the handle 116 in an embodiment may be removable from the remainder of the handle, to allow a user to easily fill the handle or a reservoir 117 thereof with water. Returning to FIG. 3, heat engine 110 is shown as including just the reactive metal oxide composition 110*a* portion of the reactive components (i.e., no water). Heat engine 110 may be packaged within an appropriate pouch material 118. For example, such pouch 118 may be permeable (e.g., another non-woven layer), so that upon introduction of water through connector 114, the liquid contacts pouch 118, permeating therethrough, so as to contact the reactive metal oxide (e.g., calcium oxide) 110*a*. In an embodiment, pouch 118 may be moisture impermeable, and be frangible, dissolvable, or otherwise penetrated to allow contact with the water at the time of activation of the heat engine.

Embodiments to be activated merely upon addition of water through the handle 116 may be particularly convenient for the user. In addition, such an embodiment allows the user to dose the amount of activating water added to the reactive metal oxide of the heat engine, providing some degree of control over the generation of steam and/or water vapor during cleaning. For example, the user may manipulate the handle (e.g., by pressing button 116*a*) on handle 116, which forces or permits passage of a volume of water within the handle from reservoir 117, through connector 114, and into contact with the reactive metal oxide 110*a* of heat engine 110. When the user desires an additional amount of steam and/or water vapor, the button 116*a* may be pressed again, delivering another volume of water through handle 116 and connector 114, into heat engine 110. Such incremental and selective addition of water may continue until all of the reactive metal oxide composition 110*a* has been spent, at which point the cleaning pad 100 can be disposed of, and replaced with another, as desired.

While button 116*a* is illustrated, it will be appreciated that various buttons, triggers, pumps, and or other suitable structures for dosing the activating water to the heat engine 110 could alternatively be employed. Use of the term "button" is to be broadly construed to include such a variety of mechanisms. In an embodiment, the orifice associated with connector 114 between handle 116 and heat engine 110 may be specifically configured to control metering of water that may be automatically delivered into heat engine 110, e.g., by influence of gravity on water within or adjacent to handle 116. Button 116*a* may rely on gravity, such that button 116*a* when not pressed results in a configuration where the passageway from reservoir 117 to the channel within connector 114 is closed. Pressing button 116*a* may open a passageway, allowing water within reservoir 117 to flow into the channel in connector 114. Various other control and dosing mechanisms will be apparent to those skilled in the art.

In another embodiment, a burstable pouch of water may be inserted or otherwise provided within handle 116, and handle 116 may include an appropriate mechanism for bursting or otherwise rupturing the pouch placed within the handle, such that the liquid contents of the pouch is permitted to flow through the handle or a reservoir, down through connector 114, and into contact with the reactive metal oxide 110*a* of heat engine 110 when heating is desired.

FIG. 2 illustrates inclusion of an optional pouch of cleaning composition 120, e.g., disposed between the heat engine 110 and the bottom substrate layer 104*b*. Such pouch may be permeable, burstable, or otherwise activated so that the cleaning composition disposed therein is entrained within the flow of steam and/or water vapor directed from heat engine 110, through vents 108. Pouch 120 could be formed of a membrane material that dissolves upon contact with water, steam and/or water vapor, or is bursted when pressure is applied thereto. In another embodiment, such a cleaning composition 120 may simply be applied to one or more layers of the substrate 104 (e.g., layer 104*a* and/or 104*b*, pouch layer 118 of heat engine 110), or elsewhere in pad 100, so that as the generated steam and/or water vapor passes therethrough, it becomes entrained within the exiting flow, passing out vents 108, and through bottom substrate layer 104*b*. Pouch of cleaning composition 120 is not shown in the cross-sectional view of FIG. 3 for simplicity, and as its presence is optional.

As will be appreciated from FIG. 3, the venting structure provided by impermeable layer 106, with vents 108 formed therethrough, in combination with housing 112 may serve to direct the generated steam and/or water vapor towards the bottom surface of the cleaning pad 100 (i.e., towards bottom layer 104*b*). Housing 112 may also be impermeable to such steam and/or water vapor, ensuring the emission of the steam and/or water vapor is only through pad layer 104*b*. Another thin membrane layer of impermeable material (e.g., polypropylene, polyethylene, or the like) similar to layer 106 may be provided above heat engine 110 (e.g., between heat engine 110 and housing 112), or on top of housing 112, as desired.

As described herein, the heat engine (e.g., 110) is advantageously incorporated into the substrate of the pad, wipe, or other cleaning article. For example, the heat engine 110 is embedded within the substrate itself, rather than simply positioned adjacent to the substrate. Such placement of the heat engine is advantageous as it allows generation of the heat within the substrate of the pad or wipe itself, and allows generation of steam or water vapor that may be emitted from the interior of the substrate.

Figure 4:
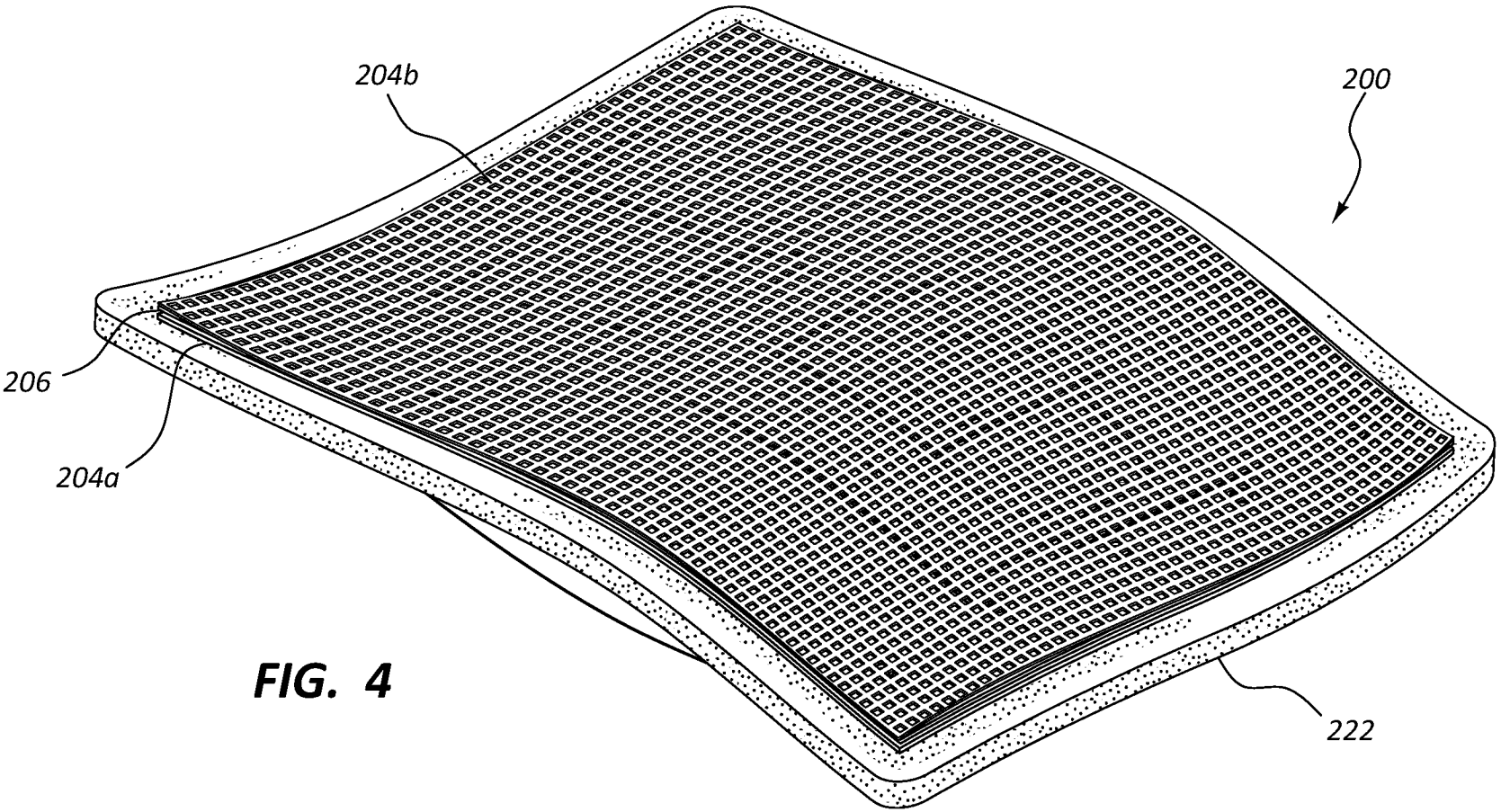
FIG. 4 is a perspective view of another exemplary cleaning article according to an embodiment of the present invention, configured for hand-held use.
Figure 5:
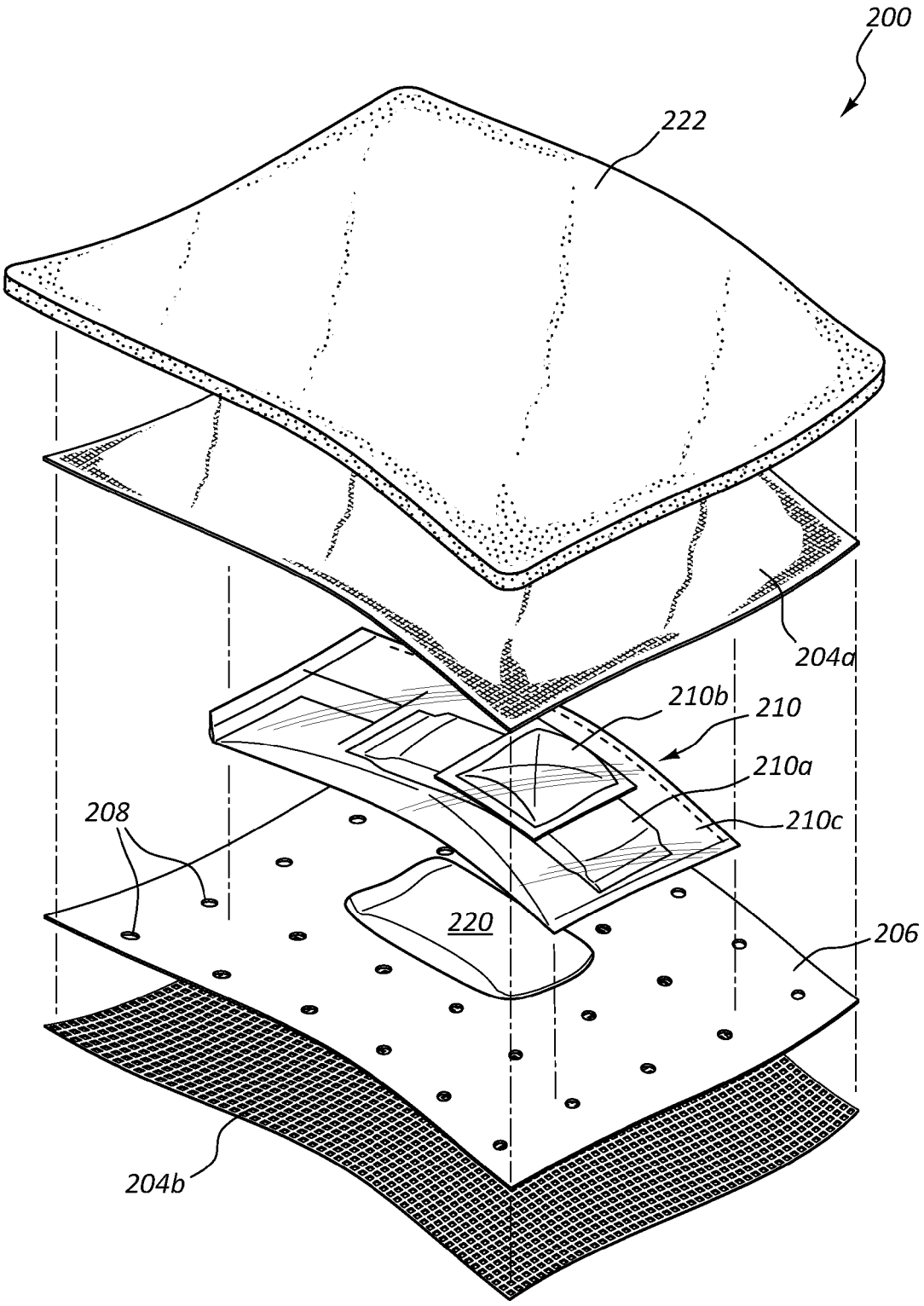
FIG. 5 is an exploded view of the cleaning article of FIG. 4.
Figure 6:
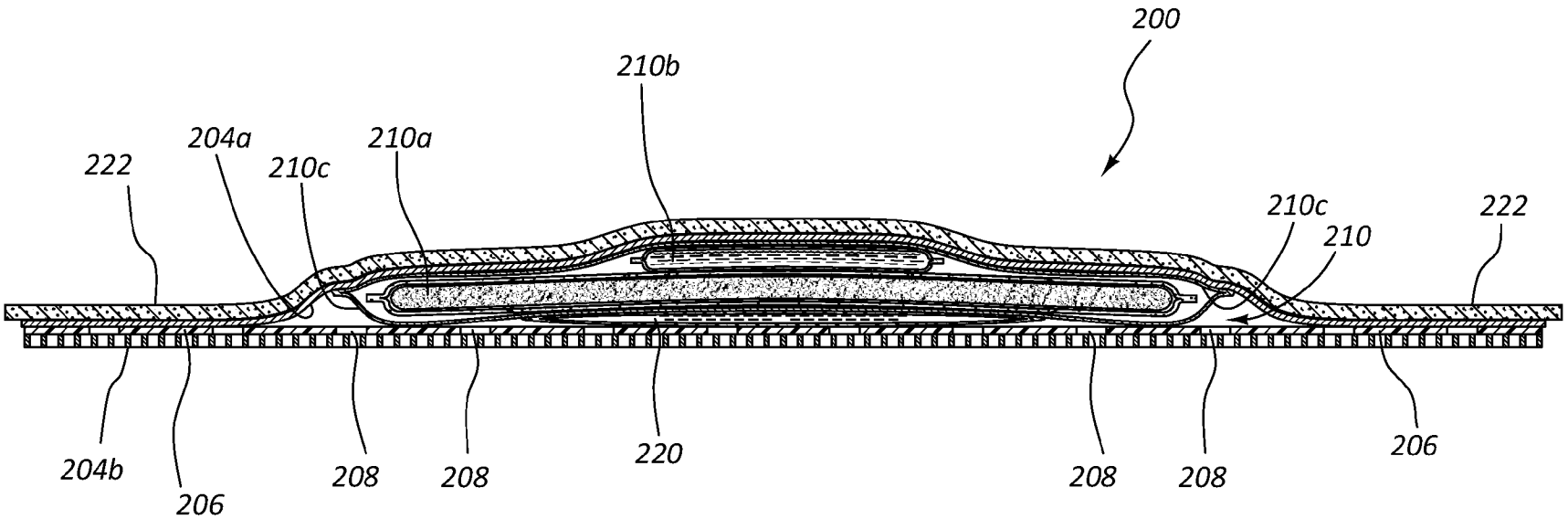
FIG. 6 is a cross-sectional view through the cleaning article of FIG. 4.

FIGS. 4-6 illustrate another example of a cleaning article configured as a pad 200, without any handle, e.g., configured for hand-held use. Cleaning article or pad 200 may be similarly configured to cleaning pad 100 in many respects. For example, FIG. 5 shows an exploded view, showing various layers and components that may be present. As shown in FIG. 5, a substrate 204 may be provided, including one or more layers. For example, a porous, absorbent, non-woven fibrous web bottom layer 204*b* may be provided. For example, the heat engine 210, and impermeable vent layer 206 including vent holes 208 may be surrounded by substrate layers 204*b* (at bottom) and layer 204*a* (at top). During manufacture, the various layers may be heat sealed or otherwise attached together (e.g., bonded with an adhesive). Combinations of such attachment mechanisms may of course be employed. Such heat sealing or other attachment may of course apply to the other embodiments described herein, as well.

In the illustrated embodiment, the heat engine 210 is shown as including a pouch of the reactive metal oxide composition 210*a*, adjacent to a pouch of water 210*b*. The heat engine components 210*a* and 210*b* are shown as packaged within their own pouch 210*c* (e.g., a non-woven, porous, permeable pouch that would allow escape of steam and/or water vapor therefrom). In an embodiment, pouch 210*c* may be impermeable, and one or more corners of pouch 210*c* may be clipped, so as to be open, providing a vent within pouch 210*c* through which generated steam and/or water vapor may exit. The length or surface area of the cut corners or other vents in such a pouch may be selected to provide a desired force at which the water vapor and/or steam is vented (e.g., smaller and/or fewer cuts may result in steam and/or water vapor emission that appears more intense). An optional cleaning composition pouch 220 is also illustrated in FIG. 5, which may function similar to cleaning composition 120 described above.

Where cleaning pad 200 is intended for hand-held use, one important consideration is the prevention of burning to the hands of the user, as the user grips or otherwise holds the pad 200 in their hand. Where the temperatures generated by the heat engine 210 are sufficiently high, it may thus be desirable to provide an insulative heat barrier layer 222. For example, such layer 222 may provide sufficiently low thermal conductivity so as to be sufficiently cool, even when the heat engine 210 is activated, so that a user may grip the "top" face of the cleaning article (adjacent layer 222), without risk of being burned. Such a layer 222 may thus insulate the hand of the user from the heat of the heat engine 210. As shown, such a layer 222 may be positioned opposite the bottom layer 204*b*, between the bottom layer 204*b* and the heat engine 210.

The heat barrier layer may comprise a variety of materials selected for their relatively low thermal conductivity, and/or ability to provide a barrier that provides low permeability or impermeability to water, water vapor, and/or steam. Suitable examples include but are not limited to: polyethylene films, polypropylene films, aluminum foils, foams, high loft non-woven materials (e.g. batting), cork, rubber, etc.

Any of the selectively heatable cleaning articles may include a phase change material on or within the article that may aid in regulating the temperature achieved by the cleaning article. For example, a material may be present that absorbs heat associated with a solid to liquid, liquid to gas, or other change in phase. Such heat energy could be released upon reversal of the phase change. Such a material may temper or otherwise regulate the temperatures achieved during activation of the heat engine. Examples of such materials include paraffin or other wax, fatty acids, hydratable or deliquescent salts, salt hydrates, polymers, and combinations thereof.

The phase-change material may include any material exhibiting a softening, melting or boiling point or phase transition at or around the target temperature or at an intermediate desired temperature of the article. The optional phase change material operates by absorbing some amount of the heat generated by the heat engine, absorbing it in some manner and then releasing the heat in a controlled and predictable manner. Without being bound by theory, the phase-change material absorbs heat to become heated to a higher than initial temperature and undergoes a phase change to a higher energy state configuration (e.g. dehydration and/or hydration of a material to a higher energy state configuration, or some other similar chemical and/or physical change etc., including simple thermal heat absorption and retention) and then releases the heat in a controlled manner to the surrounding structures and/or treatment surfaces.

In one embodiment, the phase change material operates to "smooth" out and/or control the overall emitted heat content and/or temperature profile of the heat engine, the heated article or both, and optionally the surface temperature of the surface being cleaned or treated with the activated heated article during use and contact with that surface. Alternatively, the phase change material may operate to "regulate" the temperature output of the treatment device to either prevent the generation of an excessively high and undesired temperature. The phase-change material may extend the heating effect of the treated article by first absorbing and then later releasing heat at a time period after the primary heat generation and release of energy from the air battery component has decreased and/or terminated.

In one embodiment, the presence of a sufficient quantity of phase-change material operates to prevent overheating of the treatment article by first absorbing a rapid initial increase in temperature and heat released from the heat engine, and then subsequently re-releasing this absorbed heat in a slower and thus more controlled manner. In addition, the optional phase change material operates to maintain a more uniform and steady temperature and/or regulate the heat production of the treatment article by redistributing the generated heat more uniformly across the physicality of the treatment device. Essentially, the phase-change material can enable the heat to dissipate and more uniformly heat the entire heated article and eliminate any undesired hot and/or cold spots. Furthermore, the phase change material can operate to extend the heat release from the treatment article even after the heat engine itself has ceased producing heat. For example, after all the reactive material in the heat engine has reacted or the heat engine is deactivated or stopped by the user, the phase-change material may then operate to allow heat to continue to be released from the treatment article as the phase-change material reverts to its initial state and releases any absorbed and/or stored thermal energy.

It will be apparent that the pad 200 of FIGS. 4-6 may thus not include any rigid components (e.g., no rigid scaffold or housing 112, as in FIG. 1). Of course, in another embodiment, a rigid scaffold, housing, or other rigid layer could be provided, e.g., adjacent the top gripping side of the article, if desired.

In order to activate the heat engine 210, the user need only rupture the pouch 110*b* containing the activating water. Upon rupture, the water contacts the reactive metal oxide 210*a*, leading to generation of the desired heat. While a separate cleaning composition pouch 220 is shown, it will be appreciated that such cleaning composition components could be incorporated into the water pouch 110*b*, rather than provided within a separate pouch, or could be separately disposed on any desired substrate layer. Such an embodiment would only require bursting of the pouch of activating water, and the cleaning composition provided either in the activating water composition or elsewhere within the substrate layers would be entrained within the flow of generated steam and/or water vapor, for delivery to the desired surface.

While not specifically shown, it will be appreciated that an impermeable layer may be provided on top of the heat engine 210, so as to force generated steam and/or water vapor to exit through vents 208 in layer 206, disposed below heat engine 210. Illustrated layer 204*a* and/or heat barrier layer 222 could alternatively include such an impermeable layer, if desired, to ensure the generated steam and/or water vapor is directed down, towards bottom layer 204*b*, rather than upwards, towards the user's hand (e.g., in contact with layer 222, or adjacent thereto).

Figure 7:
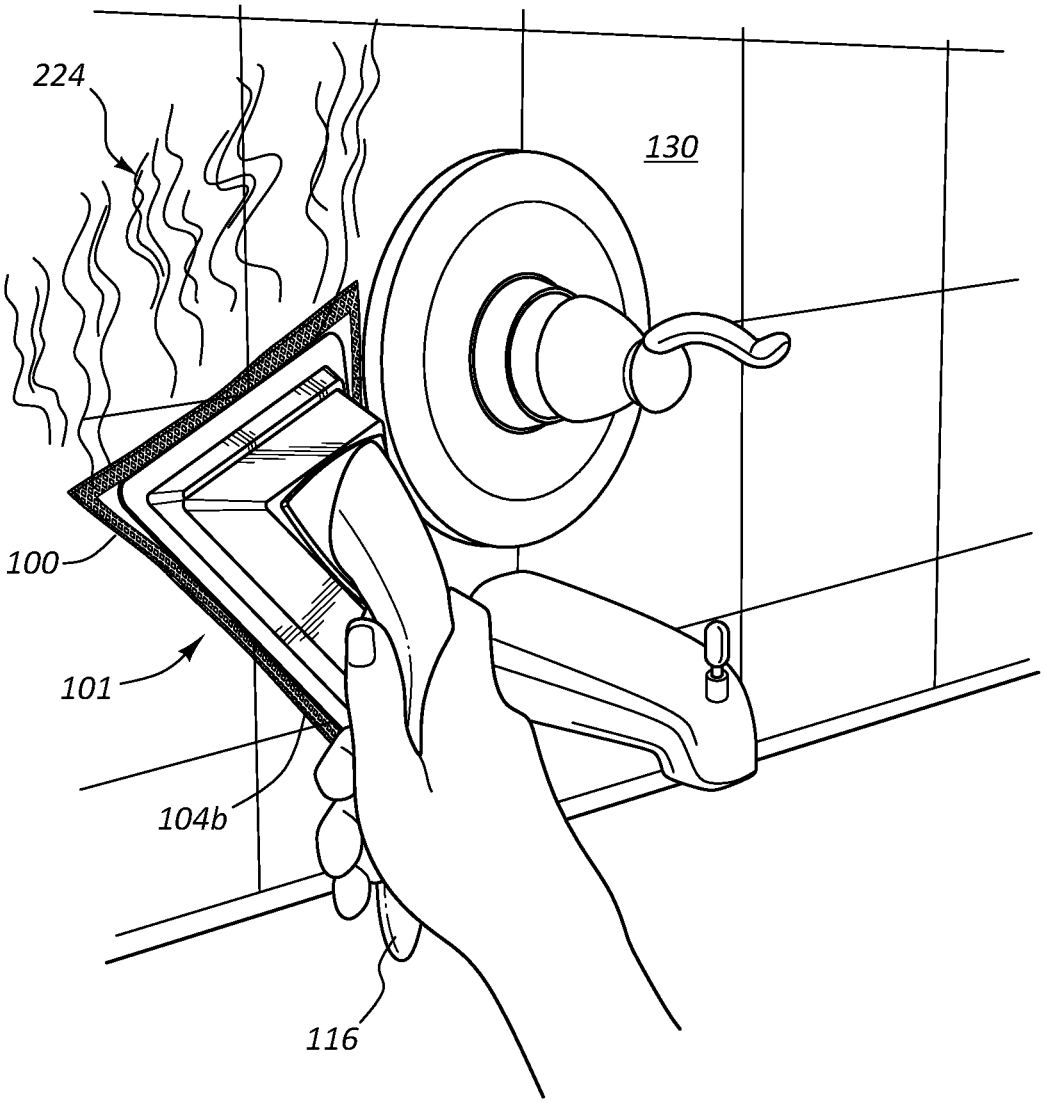
FIG. 7 is a perspective view showing an exemplary cleaning article being used to scrub a bathtub or shower.

The cleaning articles may advantageously be employed in cleaning a wide variety of surfaces. By way of example, FIG. 7 shows the cleaning article 101 of FIGS. 1-3 being used to scrub tile 130 within a shower or bathtub. The generated steam and/or water vapor 224 emitted from the heated cleaning pad 100 exits through the bottom face associated with substrate layer 104*b*. The emission of such steam and/or water vapor 224 aids in removal of the soils, debris, and other undesirable materials being scrubbed from the surface. The heat associated with steam and or water vapor 224 may further be beneficial in killing mold, mildew, or other undesirable organisms that may be present. Of course, other cleaning actives, e.g., bleach, surfactants, antimicrobials, and the like may also be delivered (e.g., through cleaning composition 120), with the steam and/or water vapor 224. Many such active components will exhibit increased efficacy when delivered under such heated conditions.

Figure 8:
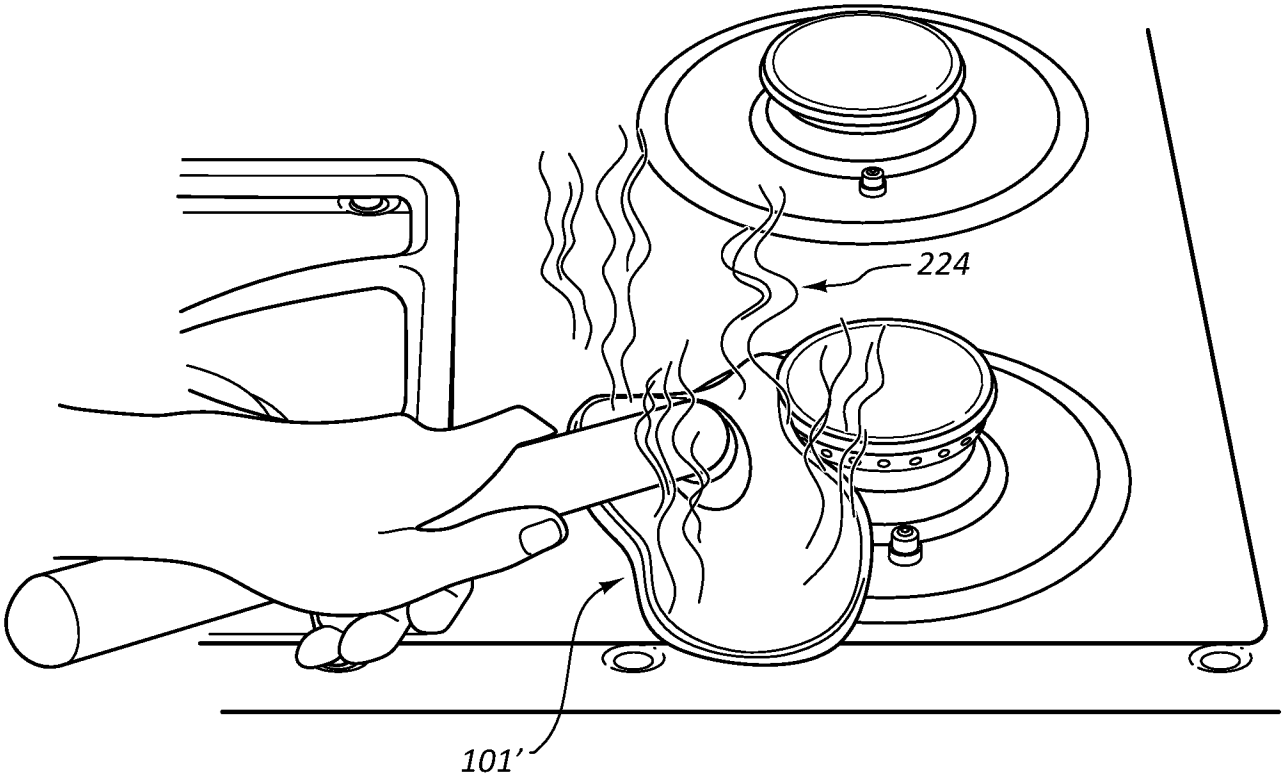
FIG. 8 is a perspective view showing an exemplary cleaning article being used to scrub a stove.

FIG. 8 shows another cleaning article 101' similar to that of FIG. 7, but with a differently configured handle, and showing how the cleaning article itself may be of any desired shape or configuration. Water vapor and/or steam 224 aid in cleaning and removal of spills, soils, debris, and other materials to be removed at the desired cleaning site (e.g., a stovetop, as shown, or other kitchen, bathroom, countertop, or other surface).

Figure 9:
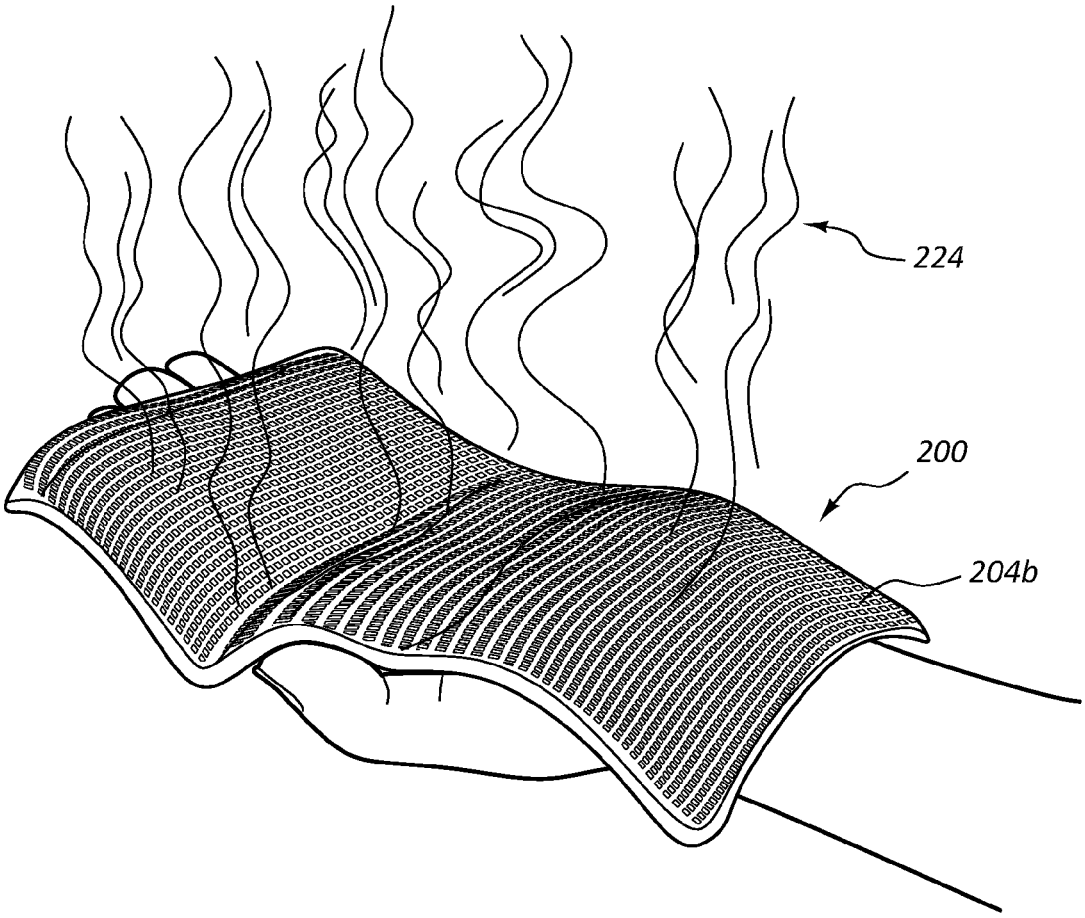
FIG. 9 is a perspective view of an exemplary cleaning device held in a user's hand in preparation for use.

FIG. 9 shows how the cleaning device 200 of FIGS. 4-6 may be held within the user's hand, with the insulative heat barrier layer 222 oriented adjacent the user's hand, so that even when activated, and held within the user's hand, the hand is not burned. This may be so, even when the surface temperature adjacent bottom cleaning surface 204*b* may be within any of the ranges described herein (e.g., about 160° F.). This is because of the presence of the heat barrier layer 222 adjacent the user's hand, which insulates the user's hand from the heat generated by the heat engine 210. In addition, the venting structure provided by layer 206, vents 208, and the impermeability of layers 204*a* and/or 222 directs the generated steam and/or water vapor away from the user's hand, towards the bottom surface and layer 204*b*, where it can be emitted adjacent the surface to be cleaned or otherwise treated. As shown in FIG. 9, use of the term "bottom" with respect to layer 204*b* is relative, as when the pad 200 is flipped over as shown, bottom layer 204*b* may be oriented towards the top.

Similarly, one or more layers or portions (e.g. pouches) of the substrate may comprise membranes which may be impervious to air, water, moisture (water vapor), or which may have relatively low permeability to one or more of air, oxygen, water, water vapor, steam, and the like. Suitable examples include but are not limited to films and membranes comprising: polyethylene, polypropylene, polyalkylenes, copolymers thereof, and other suitable materials. Suitable films and membranes may have a variety of structures, including but not limited to: coatings, films, laminates, layers of materials, pouches, bubbles, channels, strips, etc.

In an embodiment, the substrate may include one or more layers that act as an absorbent material, to aid in holding liquid water that may be associated with the heat engine, a cleaning composition, or other liquid that may be present. For example, such an absorbent material may be used in connection with the venting structure to absorb, capture, regulate (e.g., slowly release) water to keep it from dripping or escaping from the heated cleaning article in an undesirable or unsafe manner. For example, a super absorbent polymer (SAP) could be combined or commingled with the reactive metal oxide, or positioned within a substrate layer in order to capture and hold the liquid water. By positioning such a SAP within the reactive metal oxide, the water reactant may be immobilized, keeping it available for reaction with the reactive metal oxide. Along the same lines, an alternative fluid absorbing medium such as wood pulp or other materials capable of adsorbing and/or immobilizing the water can be employed. In yet another related embodiment, a reversible SAP that releases its contents when compressed, such as for example, but not limited to a low density cross-linked SAP could also be employed.

In an embodiment, a thickener may be provided to thicken the activating water, such as use of a viscosity builder, so that it does not readily flow. Such increased viscosity may minimize or prevent the thickened material from entering the vents 108, 208 intended for distribution of the water vapor and/or steam, for example.

The steam or water vapor that emanates from the cleaning article may contain some impurities that could potentially precipitate on the surface being cleaned or otherwise treated thereby forming deposits (residue) or crystalline structures that may detract from the clean impression of the surface as it dries. It would be preferable to limit escape of such residue forming materials. Suitable ways to avoid or minimize the deposition of salt, other impurities or their appearance on a treated surface include but are not limited to: trapping any impurity within the heated article so that no or limited amounts of impurities (e.g., the generated calcium hydroxide) are deposited on the treated surface, changing the appearance of the impurity deposited on the cleaned surface so that any escaping impurities or other residues are substantially uniformly distributed over the surface. In another embodiment, the heat engine itself could be completely sealed, so that the water therein does not escape, and the heat engine may be used to heat a secondary source of water, or cleaning composition, which secondary source of water or cleaning composition is emitted from the cleaning article.

Specific examples of embodiments to reduce the occurrence or impact of any residue, precipitate or impurities on the treated surface include: A) using an ion exchange resin in the path of the steam as it exits the pad to absorb the impurities and other ionic residues; B) increasing the path length of the steam as it exits to increase the fraction of impurities that are precipitated out along the path out of the steam or water vapor stream prior to the stream exiting a vent so that such impurities stay contained within the wipe or other article; C) increasing the absorbency of the surface-contacting face of the substrate to remove more of the condensed steam from the surface minimizing the amount of water, residue, contaminants, and/or impurities left behind on the surface; D) adding a surfactant, such as but not limited to, a non-ionic alkyl polyglucoside for example, to the activating and/or cleaning solution composition to produce a thin film from the condensed steam and/or water vapor, thereby spreading out any residue so that it appears by eye to resemble more of a thin, uniform film on the surface instead of crystalline "chunks"; E) adding non-volatile solvents to the heated article which will disperse residues and crystallized salts and thus decrease the formation of a noticeable film; F) add other salts (e.g. potassium carbonate) to the substrate to reduce the crystallization of the impurities; G) add sequestrants and/or chelators, such as for example, but not limited to, polymers like polyacrylic acid, to reduce crystallization and increase film formation.

As described herein, some embodiments may provide the water for the activation of the heat engine in a pouch or other membrane, packaged within the pad or wipe. Any of the pouches described herein may be friable, so that activation would only require one to mechanically activate (e.g. twist, wring, pull, etc.) the pad by hand to break the pouch, and mix the components, activating the heat engine.

A. Substrate Materials

The cleaning articles according to the present invention include some sort of cleaning substrate material, e.g., a wipe or other substrate. Such a substrate of the present invention may include one or more layers of material. In an embodiment, one or more of the layers may be a nonwoven. Exemplary nonwoven materials may be meltblown, spunbond, spunlaid, SMS (spunbond-meltblown-spunbond), coform, airlaid, wetlaid, carded webs, thermal bonded, through-air-bonded, thermoformed, spunlace, hydroentangled, needled, chemically bonded, or combinations thereof.

"Meltblown" means fibrous webs formed by extruding a molten thermoplastic material through a plurality of fine, usually circular, die capillaries as molten threads or filaments into converging high velocity heated gas. (e.g., air) streams, which attenuate the filaments of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Such a process is disclosed for example, in U.S. Pat. No. 3,849,241 to Butin et al, which is hereby incorporated by reference in its entirety. Meltblown fibers are microfibers which may be continuous or discontinuous, are generally smaller than about 0.6 denier, and are generally self-bonding when deposited onto a collecting surface. Meltblown fibers used in the present invention may be substantially continuous in length.

"Spunbond" refers to fibrous webs comprised of small diameter fibers which are formed by extruding molten thermoplastic material as filaments from a plurality of fine capillaries of a spinneret having a circular or other configuration, with the diameter of the extruded filaments then being rapidly reduced as by, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartmann, U.S. Pat. No. 3,502,538 to Petersen, and U.S. Pat. No. 3,542,615 to Dobo et al., each of which is incorporated herein in its entirety by reference. Spunbond fibers are quenched and generally not tacky when they are deposited onto a collecting surface. Spunbond fibers are generally continuous and often have average denier values larger than about 0.3, more typically, between about 0.6 and 10.

A multilayer laminate may include layers formed by multiple processes. For example, one or more layers may be spunbond and one or more layers may be meltblown such as a spunbond/meltblown/spunbond (SMS) laminate as disclosed in U.S. Pat. No. 4,041,203 to Brock et al. and U.S. Pat. No. 5,169,706 to Collier, et al., each hereby incorporated by reference in its entirety. The SMS laminate may be made by sequentially depositing onto a moving conveyor belt or forming wire first a spunbond web layer, then a meltblown web layer and last another spunbond layer and then bonding the laminate in a manner described above. Alternatively, the three web layers may be made individually, collected in rolls and combined in a separate bonding step.

"Spunlaid" materials are nonwoven fabrics made by the extrusion of filaments which are then laid down in the form of a web and subsequently bonded. The subsequent bonding of the filaments may be accomplished by a variety of different bonding techniques.

As used herein, the term "through-air bonding" or "TAB" refers to a process of bonding a nonwoven, for example, a bicomponent fiber web in which air which is sufficiently hot to melt one of the polymers of which the fibers of the web are made is forced through the web. The air velocity may be from about 100 to about 500 feet per minute and the dwell time may be as long as about 6 seconds. The melting and re-solidification of the polymer provides the bonding. Through-air bonding has relatively restricted variability since it requires the melting of at least one component to accomplish bonding. It is therefore particularly useful in connection with webs with two components like conjugate fibers or those which include an adhesive. In the through-air bonder, air having a temperature above the melting temperature of one component and below the melting temperature of another component is directed from a surrounding hood, through the web, and into a perforated roller supporting the web. Alternatively, the through-air bonder may be a flat arrangement wherein the air is directed vertically downward onto the web. The operating conditions of the two configurations may be similar, the primary difference being the geometry of the web during bonding. The hot air melts the lower melting polymer component and thereby forms bonds between the filaments to integrate the web.

"Hydroentangled" and "spunlace" refer to materials created by a method that involves forming either a dry-laid or wet-laid fiber web, where the fibers are entangled by means of very fine water jets under high pressure. Multiple rows of water jets may be directed towards the fiber web, which is carried on a moving wire. The entangled web is thereafter dried. Those fibers which are used in the material can be natural, synthetic or regenerated staple fibers, e.g., polyester, polyamide, polypropylene, rayon and the like, pulp fibers or a mixture of pulp fibers, and staple fibers. Spunlace material can be produced to a high quality at reasonable cost and display high absorption capability relative to many other methods. Spunlace materials are frequently used as wiping materials for household or industrial applications and as disposable materials within health care industries, etc.

As used herein, the term "coform" means a process in which at least one meltblown diehead is arranged near a chute through which other materials are added to the base material or the web while it is forming. Such other materials may be pulp, superabsorbent particles, cellulose or staple fibers, for example. Coform processes are shown in U.S. Pat. No. 4,818,464 to Lau, herein incorporated by reference in its entirety.

The term "carded web" refers to non-woven materials formed by the disentanglement, cleaning and intermixing of fibers to produce a continuous web, of generally uniform basis weight, suitable for subsequent processing. This is achieved by passing the fibers between relatively moving surfaces covered with card clothing. The carding processes will be readily apparent to those skilled in the art and are further described, for example, in U.S. Pat. No. 4,488,928 to Alikhan and Schmidt, each of which is incorporated by reference in its entirety.

As used herein, "bonded carded web" refers to webs that are made from staple fibers which are sent through a combing or carding unit, which breaks apart and aligns the staple fibers in the machine direction to form a generally machine direction-oriented fibrous non-woven web. Such fibers are usually purchased in bales which are placed in a picker which separates the fibers prior to the carding unit. Once the web is formed, it then is bonded by one or more of several known bonding methods. One such bonding method is powder bonding, wherein a powdered adhesive is distributed through the web and then activated, usually by heating the web and adhesive with hot air. Another suitable bonding method is pattern bonding, wherein heated calendar rolls or ultrasonic bonding equipment are used to bond the fibers together, usually in a localized bond pattern, though the web can be bonded across its entire surface if so desired. Another suitable and well-known bonding method, particularly when using conjugate staple fibers, is through-air bonding. Other suitable and well-known methods are hydroentangling or needling. Carded webs that are hydroentangled are often referred to as spunlaced.

The non-wovens used in the cleaning articles according to the invention may be produced by any of the processes described above or any combinations of these processes. In addition, various other processes for making a non-woven substrate may also be used.

One or more layers of the substrate may comprise natural fibers, synthetic fibers, or combinations thereof. Exemplary fibers include, but are not limited to polypropylene, polyethylene, polyester, PET, wood pulp, regenerated cellulose, nylon, cotton, bicomponent fibers, continuous fibers, and combinations thereof including blends or layers of one or more of the above fibers. Suitable thermoplastic fibers can be made from a single polymer and/or copolymer (monocomponent fibers), or can be made from fibers composed of more than one polymer or copolymer (e.g., bicomponent or multicomponent fibers). Multicomponent fibers are described in U.S. Pat. App. 2003/0106568 to Keck and Arnold, herein incorporated by reference in its entirety. Bicomponent fibers are described in U.S. Pat. No. 6,613,704 to Arnold and Myers, herein incorporated by reference in its entirety. Multicomponent fibers of a wide range of denier or dtex are described in U.S. Pat. App. 2002/0106478 to Hayase et. al., herein incorporated by reference in its entirety.

B. Additional Disclosure Relative to Venting Structures

According to an embodiment, the heated cleaning articles may enable the article to generate enough heat to release water vapor and/or steam, yet prevent or minimize release of other components of the heat engine. Such vents 108, 208 are shown in FIGS. 2-3 and 5-6, as described above where the cleaning article may include an impermeable layer, with one or vents (e.g., holes) through at least one surface of the impermeable layer. As shown in FIG. 2, the vents may be disposed on one face (e.g., the underside, or cleaning face) of the cleaning article, away from the user, or away from where the handle attaches to the cleaning article. Such placement may advantageously direct heated water vapor and/or steam exiting the vents to the cleaning face of the cleaning article. Such may also prevent or minimize inadvertent contact of such heated water vapor or steam from contacting the user, for increased safety.

In one embodiment of the present invention the heated article comprises a pouch within a pouch. In this embodiment, an inner pouch contains the entire heat engine assembly (the reactive metal oxide, and a water pouch) and after activation the heated article is designed so that water vapor and/or steam is allowed to escape through the vent hole(s). The outer pouch may be impermeable to liquid and gas, and may have vent holes located on one face only (the cleaning face of the article), restricting the water vapor and/or steam so that it escapes only from the face of the wipe that is to be applied against the surface to be treated. In the event that the heated article is a different three-dimensional shape than a wipe, it may be desirable to have at least some of the vents located on one or more lateral sides of the heated article. This may be particularly advantageous if the heated article is intended to be used with a cleaning tool that would allow the user to be at a safe distance from the heated article so that they would not be exposed to or contact the heated water vapor and/or steam flowing out of the heated cleaning article. In one embodiment, it may be desirable to have some of the vents located on the top of the heated article such that the steam is more visible to the consumer.

In an embodiment, the cleaning article features a heat engine assembly positioned within a pouch that has one or more openings, but which employs a channel in the form of a tortuous path (e.g., a non-linear channel, maze-like path) that may end with a "chimney" or opening which enables the article to retain and store the bulk heated water, yet allow heated water vapor and/or steam to exit after following the torturous path to the chimney, which may be open to the outside surface of the article.

In another embodiment, steam vent channels are shortened and/or made less tortuous in design so that after activating of a treatment article according to the present invention, the heated water and hot water vapor in addition to steam is released from the treatment article through the vent channels, thus being able to dissolve or interact with a cleaning/treatment composition that has previously been applied to the exterior of the treatment article in or near the vicinity of one or more vent channels.

It may also be possible to achieve directional emission of the generated heated water vapor and/or steam by folding the cleaning article or layers thereof in a manner that allows for venting of the steam and water vapor generated in a single direction. For example, the inventive cleaning article may be a cleaning wipe that is configured in the form of a three section wipe that is folded just prior to use to activate the heat engine. Such an embodiment may have a first section including the reactive metal oxide powder. A second adjacent to the first section may contain the water portion of the heat engine. Adjacent to the second section may be a third section including a water impermeable layer, which may also include an insulative, heat barrier layer.

To activate the cleaning wipe, the first section may be folded over the second section in order to bring the two sections of the wipe into intimate contact, and then the third section may be folded over in a manner that brings it in contact with the free outer surface of the first section, creating a three layer wipe ensemble where the second is now physically located on the "bottom", the first section is sandwiched between the other sections, thus being in the center, and the water impermeable third section is now located on the "top" of the folded cleaning article for convenient hand placement or attachment to a holding implement. The simple wipe or pad structure without a handle shown in FIG. 4 could be so configured.

One of the side effects of steam and/or water vapor generated by the heated cleaning article may be a "pillowing" or "ballooning" of the cleaning article during use, due to pressurization within the wipe or other substrate during activation of the heat engine. It may be desirable to prevent too much pillowing from occurring. For example, internal bridges could be formed by heat sealing during a compression stage of manufacturing, or the use of compartments, and/or attachment zones between the two extreme outer layers of the cleaning article could be provided to prevent excessive pillowing during use. In another embodiment, the cleaning article may include a pressure release valve on or adjacent to the surface that is being brought to bear (the cleaning surface) against the surface of an object being scrubbed or otherwise cleaned. This may allow the consumer to press the article during use, increasing release of steam and/or water vapor, giving the user control to direct more of the heated water vapor and/or steam against the target surface being treated.

Alternatively, the pillowing characteristic could be used to inflate a protruding handle on the cleaning article, which could be gripped to help maintain control during cleaning.

C. Various Alternative Configurations

There are several approaches that would enable this heat engine technology to be adapted for use in heating a standalone heated cleaning article. For example, in one embodiment, one could package the reactive metal oxide composition in a porous nonwoven pouch, with water in a separate, water impermeable, but frangible (i.e., burstable) pouch. Both pouches could be co-located within a third waterproof pouch. During use, one would rupture the water pouch to introduce the water to the reactive metal oxide composition, initiating the heat engine reaction.

Alternatively, in another embodiment, one could use multiple frangible water "bubbles" (i.e. pouches) that are activated by breaking the bubble (e.g. wringing, compressing, pulling, etc.). The wipe could selectively be wrung, compressed, pulled, or otherwise manipulated again and again, to successively break the bubbles, releasing more water with each broken bubble to first initiate and then refuel the heat engine reaction with the reactive metal oxide composition.

In yet another embodiment, one could place the reactive metal oxide and the water components in separate layered pouches. An opening mechanism (e.g. pull-tab, breakable seal, etc.) could then be used to open a pathway between the two pouches thus initiating the heat engine reaction. In this embodiment, one could use a piercing operation in addition to the pull-tab to ensure complete opening of the pouch and subsequent reaction of the components.

In a further embodiment, one could put a reactive metal oxide and water activator into two separate pouches both fully contained within a third, larger pouch. In this embodiment, an activation step may release the reactive metal oxide, and a subsequent or simultaneous second activation step may release the water into the common space of the larger tertiary pouch. Shaking or agitation may mix the contents of the two pouches to initiate the exothermic chemical reaction. In one embodiment, these steps could employ pressure or force in different directions. By employing force in different directions for activation, the likelihood that they would accidently activate during shipping would be greatly reduced. In another configuration, both the reactive metal oxide and water may be in a single sub-divided pouch which can optionally be packaged within the waterproof outer pouch.

In another embodiment, the inventive treatment article features a central reactive metal oxide pouch within a larger pouch also having within several water pouches collocated adjacent to the central pouch (e.g., surrounding, or on either side of it). A user can then control the initiation, speed and duration of the heating effect by selectively bursting one or more pouches simultaneously or sequentially in order for the heat engine to generate heat and achieve the desired temperature for performing treatment, such as cleaning a surface.

In another embodiment, the inventive treatment article may feature a nonwoven cleaning article, such as a wipe or pad, integrated with (e.g. attached, layered, fused, co-joined, etc.) a first outer pouch loaded with an activating water composition and a second pouch loaded with the reactive metal oxide. To activate the heat engine, the user may place the second pouch within the first outer pouch and then employ some appropriate mechanical pressure applied against the second pouch sufficient to rupture it and release its contents so as to activate the exothermic reaction, heating the pouch and the outer surface of the pouch bearing the cleaning article.

Activation may be achieved by a wide variety of different mechanisms, by way of example: twisting, piercing, pulling apart, or severely bending the article, or any such externally applied mechanical deformation sufficient to rupture a barrier between at least two packets or rupturing at least one of the packets. The activation mechanism may be completed by the user rupturing one or more pouches in the article, or alternatively it may occur when the user attaches the article to a cleaning tool (e.g. a handle, mop head, scrubber tool, etc.) having an activating mechanism present, or yet alternatively as the user first applies pressure to the cleaning tool in the process of cleaning or treating a surface against which the inventive article is in contact. In another embodiment, the reactive metal oxide may be positioned within the cleaning article (e.g., wipe), within a porous or impermeable pouch or other container, and water may be added through the handle or other tool, resulting in activation of the heat engine upon contact of the water with the reactive metal oxide composition. If the pouch of reactive metal oxide composition is impermeable, attachment of the handle to the wipe or other cleaning article may serve to irreversibly rupture the pouch.

In another embodiment, the cleaning device may be in the form of two separate treatment articles, for example wipes, each loaded separately with one of either the reactive metal oxide powder or the water. To activate the device, one would simply align, hold or stack the wipes adjacent to one another, and then twist, press or wring the wipes together in order for the contents of the two to mix, and thereby initiate the exothermic reaction, heating the assembled device components.

In another embodiment, one could partition the heat engine components to two locations on a treatment or cleaning article, such as a wipe, thus having one of the two components of the heat engine present, but not touching or in communication with one another on the wipe such as in an immediately adjacent side-by-side configuration, but separated by a gap, barrier or other means for keeping the two sides out of reactive contact. Thus, one side may be loaded with the reactive metal oxide powder component of the heat engine, and the other side of the device could be wetted with water. The wipe could then be activated to produce heat by folding one side of the wipe or other device so as to contact the other side, bringing the two component parts of the heat engine into close contact. In this embodiment, any premature reaction is prevented prior to use by the packaging, or use of a barrier or a gap between the two locations of the heat engine components on the substrate or treatment article.

In an embodiment, a thermochromic dye and/or label may be provided, e.g., attached to one side of the cleaning article (e.g. the top side that is viewed by the user during operation). Such a color-changing material may provide a visual signal to the user that the cleaning article has achieved some desired temperature increase, signaling that it is ready for use. Such a color-changing material may also signal to the user that the previously heated surface has now cooled below a threshold temperature, and may be safely disposed of after use (e.g., safe to touch without risk of burning).

In an embodiment, a fragrance or volatilized treatment composition may be provided within the article, so that upon heating, the fragrance or volatilized treatment composition is released into the air. Such an article may be principally intended for use as an air-freshening device, rather than for scrubbing or otherwise cleaning. Such may be intended for placement within a room, or a relatively small enclosed air space, such as, but not limited to a trash can, a diaper pail, a shower stall, a toilet, etc.

Another embodiment for treating an air space may include a volatile disinfectant, for example, selected from but not limited to: hydrogen peroxide, formaldehyde, alcohol, a chlorine bleach such as hypochlorous acid or salt thereof, triclosan, and/or any other volatile and/or air dispersible antimicrobial, biocide, germicide and/or other odor control material that has a vapor pressure that is increased by a rise in temperature and thus effectively volatized into the air during operation of such an air-freshening device after activation of the heat engine. Optionally, the heated article may also produce steam as a vapor carrier for dispersing one or more of the selected active materials desired for use in treating an air space.

In a further embodiment, an outer packaging of an air treatment device could be a flexible non-woven or similar textile-like pouch (rather than rigid), and the nonwoven or textile surface could be impregnated or loaded with a suitable air treatment composition, which could be carried into the air with water vapor and/or steam being emitted from the device.

Another embodiment may include a water pouch positioned next to a first of two reactive metal oxide composition portions of the heat engine so that when ruptured, the first metal oxide composition is activated, heating the water, so as to release steam and/or water vapor. When the heated article is heated sufficiently, the steam and gases can escape the heat engine assembly through the one or more steam vents. In this embodiment, the steam vent may operate to direct steam into a compartment holding the second of two metal oxide composition portions. The second heat engine component is in turn activated to release additional heat and steam from vents located adjacent thereto. Such an embodiment may create a sequential activation of the calcium oxide or other metal oxide heat engine components which may be employed to lengthen the time that the heated article produces heat, to increase the heat generated by the article, or both.

Although FIGS. 1 and 8 show a relatively short handle, it will be appreciated that other handles, tools, etc. may be attached to the cleaning pad. For example, a mop handle could be attached.

D. Cleaning Compositions

As described herein, the wipe, pad, or other cleaning article may include a cleaning composition therein. By way of example, such a cleaning composition may typically be aqueous, although it will be appreciated that a thickened lotion, substantially dry to the touch cleaning composition, or other cleaning composition may be provided on or within the wipe or pad. Examples of components that may be included in such a cleaning composition include, but are not limited to one or more of an oxidant (e.g., bleaching agent), electrolyte, surfactant, solvent, antimicrobial agent, buffer, stain and soil repellant, lubricant, odor control agent, perfume, fragrance, fragrance release agent, acid, base, dyes and/or colorant, solubilizing material, stabilizer, thickener, defoamer, hydrotrope, cloud point modifier, preservatives, polymer, and combinations thereof.

1. Oxidants

The cleaning compositions may include one or more oxidants and/or bleaching agents. Preferred oxidants include, but are not limited to, hydrogen peroxide, alkaline metal salts and/or alkaline earth metal salts of hypochlorous acid (e.g., sodium hypochlorite), hypochlorous acid, solubilized chlorine, any source of free chlorine, solubilized chlorine dioxide, acidic sodium chlorite, active chlorine generating compounds, active oxygen generating compounds, chlorine-dioxide generating compounds, solubilized ozone, sodium potassium peroxysulfate, sodium perborate, and combinations thereof. When present, the one or more oxidants can be present at a level of from 0.001% to 10%, from 0.01% to 10%, from 0.1% to 5%, or from 0.5% to 2.5% by weight.

2. Buffers & Electrolytes

Buffers, buffering agents and pH adjusting agents, when used, include, but are not limited to, organic acids, mineral acids, alkali metal and alkaline earth salts of silicate, metasilicate, polysilicate, borate, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2methylpropanol. Exemplary buffering agents include dicarboxlic acids, such as, succinic acid and glutaric acid. Some suitable nitrogen-containing buffering agents are amino acids such as lysine or lower alcohol amines like mono-, di-, and tri-ethanolamine. Other nitrogen-containing buffering agents are Tri(hydroxymethyl) amino methane $(HOCH_2)_3CNH_3$ (TRIS), 2-amino-2-ethyl-1,3-propanediol, 2-amino-2-methyl-propanol, 2-amino-2-methyl-1,3-propanol, disodium glutamate, N-methyl diethanolamide, 2-dimethylamino-2-methylpropanol (DMAMP), 1,3-bis(methylamine)-cyclohexane, 1,3-diamino-propanol N,N'-tetra-methyl-1,3-diamino-2-propanol, N,N-bis(2-hydroxyethyl)glycine (bicine) and N-tris (hydroxymethyl)methyl glycine (tricine). Other exemplary buffers include ammonium carbamate, citric acid, and acetic acid. Mixtures of one or more buffers may also be acceptable. Useful inorganic buffers/alkalinity sources include ammonia, the alkali metal carbonates and alkali metal phosphates, e.g., sodium carbonate, sodium polyphosphate. By way of example, when present, the buffer may be preferably present at a concentration of from about 0.001% to about 20%, from about 0.05% to about 1%, from about 0.05% to about 0.5%, or from about 0.1% to about 0.5% by weight.

3. Antimicrobial Agents

The cleaning compositions may include antimicrobial (germicidal) agents or biocidal agents. Such antimicrobial agents can include, but are not limited to, alcohols, chlorinated hydrocarbons, organometallics, halogen-releasing compounds, metallic salts, pine oil, organic sulfur compounds, iodine compounds, silver nitrate, quaternary ammonium compounds (quats), chlorhexidine salts, and/or phenolics. Antimicrobial agents suitable for use in the compositions of the present invention are described in U.S. Pat. Nos. 5,686,089; 5,681,802, 5,607,980, 4,714,563; 4,163,800; 3,835,057; and 3,152,181, each of which is herein incorporated by reference in its entirety.

Also useful as antimicrobial agents are the so-called "natural" antibacterial actives, referred to as natural essential oils. These actives derive their names from their natural occurrence in plants. Suitable antimicrobial agents include alkyl alpha-hydroxyacids, aralkyl and aryl alpha-hydroxyacids, polyhydroxy alpha-hydroxyacids, polycarboxylic alpha-hydroxyacids, alpha-hydroxyacid related compounds, alpha-ketoacids and related compounds, and other related compounds including their lactone forms. Preferred antimicrobial agents include, but are not limited to, alcohols, chlorinated hydrocarbons, organometallics, halogen-releasing compounds, metallic salts, pine oil, organic sulfur compounds, iodine, compounds, antimicrobial metal cations and/or antimicrobial metal cation-releasing compounds, chitosan, quaternary alkyl ammonium biocides, phenolics, germicidal oxidants, germicidal essential oils, germicidal botanical extracts, alpha-hydroxycarboxylic acids, and combinations thereof. When included, the one or more antimicrobial agents may be present at a concentration of from about 0.001% to about 10%, from about 0.05% to about 1%, from about 0.05% to about 0.5%, or from 0.1% to about 0.5% by weight.

4. Solvents

Water may be used as a solvent alone, or in combination with any suitable organic solvents. Such solvents may include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. In one embodiment of the invention, water may comprise at least 30%, at least 40%, at least 50%, at least 60%, at least 70%, at least 80%, at least 90%, or at least 95% of a cleaning composition by weight. Of course, lotions, or dry to the touch cleaning compositions will typically have relatively lower water concentration. Where included, one or more organic solvents can be present at a level of from 0.001% to 10%, from 0.01% to 10%, from 0.1% to 5%, or from 1% to 2.5% by weight.

5. Surfactants

A cleaning composition included within the wipe or pad of the present invention may contain surfactants selected from nonionic, anionic, cationic, ampholytic, amphoteric and zwitterionic surfactants and mixtures thereof. A typical listing of anionic, ampholytic, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Where present, the one or more surfactants may be present at a level of from 0% to about 90%, from about 0.001% to about 50%, or from about 0.01% to about 25% by weight. Alternatively, surfactants may be present at a level of from about 0.1% to about 10%, from about 0.1% to about 5%, or from about 0.1% to 1% by weight. Where sudsing action is desired from the cleaning composition, a surfactant that generates foam may be desired.

6. Additional Adjuvants

The cleaning compositions may optionally contain one or more of the following adjuncts: stain and soil repellants, lubricants, odor control agents, perfumes, fragrances and fragrance release agents, and bleaching agents. Other adjuncts include, but are not limited to, acids, bases, dyes and/or colorants, solubilizing materials, stabilizers, thickeners, defoamers, hydrotropes, cloud point modifiers, preservatives, chelating agents, water-immiscible solvents, enzymes and polymers.

Without departing from the spirit and scope of the invention, one of ordinary skill can make various changes and modifications to the invention to adapt it to various usages and conditions. As such, these changes and modifications are properly, equitably, and intended to be, within the full range of equivalence of the following claims.

The invention claimed is:

1. A selectively heatable cleaning article comprising:

(a) a cleaning substrate material comprising one or more layers;

(b) a heat engine comprising a reactive metal oxide that generates heat upon contact with water;

(c) a handle attachable to the cleaning substrate, the handle including a delivery channel therethrough in fluid communication with the reactive metal oxide of the heat engine so that upon introduction of an activating water composition through the delivery channel, the heat engine is activated, generating heat; and (d) a venting structure surrounding or adjacent to the heat engine comprising a moisture impermeable material containing one or more vents through at least one surface of the moisture impermeable material for releasing steam and/or water vapor generated by the heat engine, so that the venting structure directs the water vapor and/or steam through the one or more vent holes on one face of the cleaning article, opposite a face on which the handle is attachable.

2. The heated article of claim 1 wherein the reactive metal oxide composition comprises calcium oxide.

3. The selectively heatable cleaning article of claim 1 wherein the selectively heatable cleaning article further comprises a heat barrier layer on a face opposite from where water vapor and/or steam generated by the heat engine exits the cleaning article.

4. The selectively heatable cleaning article of claim 1, wherein the selectively heatable cleaning article further comprises a rigid housing that allows pressure to be applied to the article by the handle or otherwise, while reducing or preventing seepage of liquid water from the heat engine due to compression.

5. The selectively heatable cleaning article of claim 1, wherein the handle further comprises a member selected from the group consisting of a dispenser, button, and trigger for selectively dosing water through the handle or a reservoir to the heat engine.

6. The selectively heatable cleaning article of claim 1, wherein the selectively heatable cleaning article further comprises a cleaning composition.

7. The selectively heatable cleaning article of claim 1, wherein the selectively heatable cleaning article further comprises a phase change material on or within the article that regulates temperature achieved by the cleaning article.

8. The selectively heatable cleaning article of claim 1, wherein one or more of the one or more layers of the substrate are absorbent to minimize or prevent dripping of liquid water from the heat engine.

9. The selectively heatable cleaning article of claim 1, wherein the heat engine heats the cleaning article to a temperature that is from about 120° F. to about 160° F.

10. A selectively heatable cleaning article comprising:

(a) a cleaning substrate material comprising one or more layers;

(b) a heat engine comprising:

(i) a reactive metal oxide; and (ii) water provided in a frangible container;

(c) a venting structure surrounding the heat engine comprising a moisture impermeable material containing one or more vents on at least one surface of the impermeable material for releasing steam and/or water vapor generated by the heat engine.

11. The selectively heatable cleaning article of claim 10 wherein the reactive metal oxide comprises calcium oxide.

12. The selectively heatable cleaning article of claim 10, wherein one or more of the one or more layers of the substrate are absorbent to minimize or prevent dripping of liquid water from the heat engine.

13. The selectively heatable cleaning article of claim 10 wherein the venting structure is configured to control the direction of water vapor and/or steam generated by the heat engine, so as to direct the water vapor and/or steam through the one or more vent holes on one face of the heatable cleaning article.

14. The selectively heatable cleaning article of claim 10 wherein the selectively heatable cleaning article further comprises a heat barrier layer on a face opposite from where water vapor and/or steam generated by the heat engine exits the cleaning article, to allow a user to hold the cleaning article on the face including the heat barrier layer while reducing risk of a burn.

15. The selectively heatable cleaning article of claim 10, wherein the selectively heatable cleaning article further comprises a cleaning composition.

16. A selectively heatable cleaning article comprising:

(b) a cleaning substrate material comprising one or more layers;

(b) a heat engine comprising:

(i) a reactive metal oxide; and (ii) wherein upon addition of water to the heat engine, a heating reaction between the reactive metal oxide and the water composition is initiated;

(c) a venting structure surrounding the heat engine comprising a moisture impermeable material containing one or more vents through at least one face of the impermeable material, so as to direct water vapor and/or steam generated by the heat engine to exit from the cleaning article from a face thereof; and (d) a heat barrier layer on a face opposite from where the water vapor and/or steam generated by the heat engine exits the cleaning article, to allow a user to hold the cleaning article on the face including the heat barrier layer while reducing risk of a burn.

17. The selectively heatable cleaning article of claim 16, wherein one or more of the one or more layers of the substrate are absorbent to minimize or prevent dripping of liquid water from the heat engine.

18. The heated article of claim 16 wherein the reactive metal oxide comprises calcium oxide.

19. The selectively heatable cleaning article of claim 16, wherein the selectively heatable cleaning article further comprises a cleaning composition.

* * * * *